US008588662B2

(12) United States Patent
Kunihiro

(10) Patent No.: US 8,588,662 B2
(45) Date of Patent: Nov. 19, 2013

(54) DEVELOPING DEVICE AND IMAGE FORMING APPARATUS INCLUDING THE SAME

(75) Inventor: Hisashi Kunihiro, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 171 days.

(21) Appl. No.: 13/189,749

(22) Filed: Jul. 25, 2011

(65) Prior Publication Data

US 2012/0027470 A1 Feb. 2, 2012

(30) Foreign Application Priority Data

Jul. 29, 2010 (JP) ..... 2010-170342

(51) Int. Cl.
*G03G 15/09* (2006.01)

(52) U.S. Cl.
USPC ..... 399/273; 399/274

(58) Field of Classification Search
USPC ..... 399/273
See application file for complete search history.

(56) References Cited

U.S. PATENT DOCUMENTS 4,666,283 A * 5/1987 Iida et al. ..... 399/63
5,097,295 A * 3/1992 Tanaka ..... 399/62
2006/0182456 A1 8/2006 Naoi et al.
2007/0036968 A1* 2/2007 Shimamura et al. ..... 428/323
2007/0212115 A1 9/2007 Kunihiro et al.
2009/0029279 A1* 1/2009 Mori et al. ..... 430/109.1
2009/0226220 A1 9/2009 Kunihiro et al.
2009/0245892 A1* 10/2009 Obara et al. ..... 399/286

FOREIGN PATENT DOCUMENTS

JP 03-168779 A 7/1991
JP 04-009978 A 1/1992
JP 10-063081 A 3/1998
JP 2007-241047 A 9/2007
JP 2008-015253 A 1/2008

* cited by examiner

*Primary Examiner* — Clayton E Laballe
*Assistant Examiner* — Jas Sanghera
(74) *Attorney, Agent, or Firm* — Renner, Otto, Boisselle & Sklar, LLP

(57) ABSTRACT

A developing device 2 includes a developer collecting guide member 128 for carrying a residual developer on the surface of a developing roller 114 in a direction from the developing roller 114 to a carrying member 112, the developer collecting guide member 128 including (i) a first inclined plane 128*b* that guides the residual developer to a position in a carrying path P which position is between a first side wall 117 and a rotary shaft of the carrying member 112 and (ii) a second inclined plane 128*c* which has a smaller angle of inclination than the first inclined plane 128*b* and guides the residual developer to the carrying path P, the second inclined plane 128*c* having an end section present downstream in a developer guiding direction, the end section reaching a position between the side wall 111*a* and the rotary shaft, and tapering in area to the end section.

12 Claims, 9 Drawing Sheets

DEVELOPING DEVICE AND IMAGE FORMING APPARATUS INCLUDING THE SAME

This Nonprovisional application claims priority under 35 U.S.C. §119(a) on Patent Application No. 2010-170342 filed in Japan on Jul. 29, 2010, the entire contents of which are hereby incorporated by reference.

TECHNICAL FIELD

The present invention relates to a developing device and an image forming apparatus. In particular, the present invention relates to a developing device and an image forming apparatus each of which collects a residual developer into a carrying path.

BACKGROUND ART

An image forming apparatus employing an electrostatic electrophotography printing method generally carries out steps of charging, exposing, developing, transferring, cleaning, charge removing, and fixing, so as to form an image. In a charging step, a surface of a photoreceptor which is driven to rotate is uniformly charged by a charging device. In an exposing step, the charged surface of the photoreceptor is irradiated with a laser beam emitted from an exposure device so that an electrostatic latent image is formed. Then, in a developing step, the electrostatic latent image formed on the photoreceptor is developed with a developer by a developing device so that a toner image is formed on the surface of the photoreceptor. After that, in a transferring step, the toner image formed on the photoreceptor is transferred to a recording material by a transfer device. Then, in a fixing step, the recording material is heated and pressured by a fixing device so that the toner image is fixed on the recording material. Further, in a cleaning step, a residual toner that has net been transferred in the transferring and remains on the surface of the photoreceptor is removed by a cleaning device so as to be collected into a predetermined collection section. Then, in a charge removing step, a residual charge is removed, by a charge removing device, from the surface of the photoreceptor that has been subjected to the cleaning step. The image forming apparatus becomes then ready for formation of a next image.

The developer used to develop the electrostatic latent image formed on the photoreceptor in the developing step is generally a single-component developer made of only a toner, or a two-component developer made of a toner and a carrier. The single-component developer contains no carrier. For this reason, with the single-component developer, it is unnecessary for the developing device to employ a stirring mechanism for mixing a toner and a carrier with each other uniformly, or the like. Accordingly, the single-component developer has an advantage of a simple arrangement of the developing device. However, the single-component developer also has disadvantages, such as an inconstant charge amount of the toner. On the other hand, with the two-component developer, it is necessary for the developing device to employ the stirring mechanism for mixing a toner and a carrier with each other uniformly, or the like. For this reason, the two-component developer has a disadvantage of a complex arrangement of the developing device. However, the two-component developer is excellent in stability of a charge amount of the toner. Accordingly, the two-component developer is now suitably used in devices such as a high-speed image forming apparatus and a color image forming apparatus.

In a case where an image forming apparatus uses such a two-component developer, it is necessary to, inside a small space, (i) charge the developer rapidly and sufficiently and also (ii) carry the developer rapidly since there has been a demand for a high-speed, downsized image forming apparatus. In view of this, Patent Literature 1 discloses an image forming apparatus which includes a circulation-type developing device. As disclosed in Patent Literature 1, the circulation-type developing device includes (i) a developer carrying path through which a developer in a developing tank (developing container; developer container) is carried circularly and (ii) a developer carrying member for carrying and stirring the developer in the developer carrying path. According to Patent Literature 1, the developer carrying member is a screw including (i) a blade having a feed screw shape and (ii) a mesh screen member.

CITATION LIST

Patent Literature 1

Japanese Patent Application Publication, Tokukaihei, No. 10-63081 A (Publication Date: Mar. 6, 1998)

Patent Literature 2

Japanese Patent Application Publication, Tokukaihei, No. 4-9978 A (Publication Date: Jan. 14, 1992)

Patent Literature 3

Japanese Patent Application Publication, Tokukaihei, No. 3-168779 A (Publication Date: Jul. 22, 1991)

SUMMARY OF INVENTION

Technical Problem

The above circulation-type developing device is arranged such that in a case where a toner density of the developer in the developing tank falls below a predetermined value, toner is supplied from a toner hopper to the developer carrying path. Such a conventional circulation-type developing device as disclosed in Patent Literature 1, however, has had a problem that the toner supplied from the toner hopper to the developer carrying path may be carried circularly in a form of aggregates without being sufficiently mixed with the developer that has already been in the developer carrying path. That is, toner is carried circularly while separated from the carrier. As a result, toner that has not been charged sufficiently (poorly charged toner) is supplied to the developer bearing member (developing roller).

In the case where toner which has not been charged sufficiently is supplied to a developer bearing member as described above, there likely occurs a problem that toner is scatter from the developer bearing member, so that an inside of the image forming apparatus or a formed image is spotted with the toner scattered from the developing roller. Further, in the case where toner which has not been charged sufficiently is supplied to the developer bearing member, there is a reduction in adhesion of the toner to the toner toward an electrostatic latent image on a photoreceptor. This causes a further problem that a photographic fog is likely to occur in a developed image.

Further, when printing is carried out, with high-density, with respect to a plurality of sheets sequentially, toner on a surface of the developer bearing member is consumed in a larger amount. In this case, if a residual developer on the developer bearing member is collected directly below the developer bearing member, the developer cannot be stirred rapidly enough. This results in a faded image. Such a residual developer collected from the developer bearing member may be allowed to drop, instead of directly below the developer bearing member, in a direction toward the carrying member with use of a sliding plate or the like as in developing devices disclosed in Patent Literatures 2 and 3. In this case, however, the residual developer drops in an inclination direction of the sliding plate, and efficiency in mixing the collected residual developer and the supplied toner with each other becomes poor. Neither of Patent Literatures 2 and 3 discusses a location at which a residual developer drops. Thus, in the developing devices of Patent Literatures 2 and 3 also, a developer is circulated without being stirred sufficiently. This causes toner to be scattered, and such scattered toner results in an image defect such as a photographic fog.

The present invention has been accomplished in view of the above problem. It is an object of the present invention to promote, in a developing device included in an image forming apparatus employing an electrophotographic printing method, stirring of a developer and thus supply sufficiently charged toner to a developing roller so as to reduce problematic toner scattering and photographic fog.

Solution to Problem

In order to solve the above problem, a developing device of the present invention is a developing device, including: a developer container for storing a developer including a toner and a carrier; a developing roller provided in the developer container; a carrying path including a first side wall and a second side wall, the first side wall being closer to the developing roller than the second side wall is; a carrying member which is provided in the carrying path and which rotates about a rotary shaft so as to carry the developer while stirring the developer; and a supply opening which is formed in an upper wall of the developer container and via which the toner is supplied into the carrying path; the developing roller (i) rotating while holding, on a surface, the developer that has been carried by the carrying member and (ii) supplying the developer to an image bearing member in a developing area, in which the developing roller faces the image bearing member, and the developing device further including: a developer collecting guide member which is provided downstream from the developing area in a rotational direction of the developing roller and which carries a residual developer on the surface of the developing roller in a direction from the developing roller to the carrying member, the developer collecting guide member including: a first inclined plane which guides the residual developer to a first position in the carrying path which first position is between the first side wall and the rotary shaft of the carrying member; and a second inclined plane which has an angle of inclination, the angle being smaller than an angle of inclination of the first inclined plane and which guides the residual developer to the carrying path, the second inclined plane (i) having an end section present downstream in a first direction in which the residual developer is guided on the second inclined plane, the end section reaching a second position between the second side wall and the rotary shaft of the carrying member and (ii) tapering in area to the end section.

Advantageous Effects of Invention

According to the above arrangement, a residual developer on the surface of the developing roller is guided to the carrying path via the first inclined plane and the second inclined plane. The first inclined plane guides the residual developer to a position in the carrying path which position is between the first side wall and the rotary shaft of the carrying member.

The second inclined plane is provided so as to taper in area to the end section. Thus, the residual developer carried via the second inclined plane hardly reaches the end section, and instead drops from either side of the second inclined plane. Such a residual developer dropping from the sides is consequently guided to the carrying path in a direction bent from an inclination direction of the second inclined plane.

The second inclined plane has an angle of inclination which angle is smaller than an angle of inclination of the first inclined plane, and tapers in area to the end section in the direction in which the residual developer is guided, the end section reaching a position between the second side wall and the rotary shaft of the carrying member. The residual developer carried via the second inclined plane thus drops over and across the carrying member in a cross section taken along a direction from the first side wall to the second side wall. In other words, the residual developer carried along the second inclined plane and dropping therefrom forms a hook-shaped curtain over and across the carrying member.

The above arrangement allows the residual developer guided via the first inclined plane and the second inclined plane to hold down supplied toner in the carrying path while the toner is mixed with developer. The above arrangement thus accelerates the mixing of toner with developer. The residual developer guided via the second inclined plane is guided to the carrying path in a bent direction as described above. This further improves efficiency in the mixing of toner with developer.

As described above, the developing device of the present invention accelerates the mixing of toner with developer and the stirring of developer, and consequently supplies sufficiently charged toner to the developing roller. As such, it is possible to reduce problematic toner scattering and photographic fog.

DESCRIPTION OF EMBODIMENTS

One embodiment of the present invention is described below with reference to drawings.

<Image Forming Apparatus>

Figure 2:
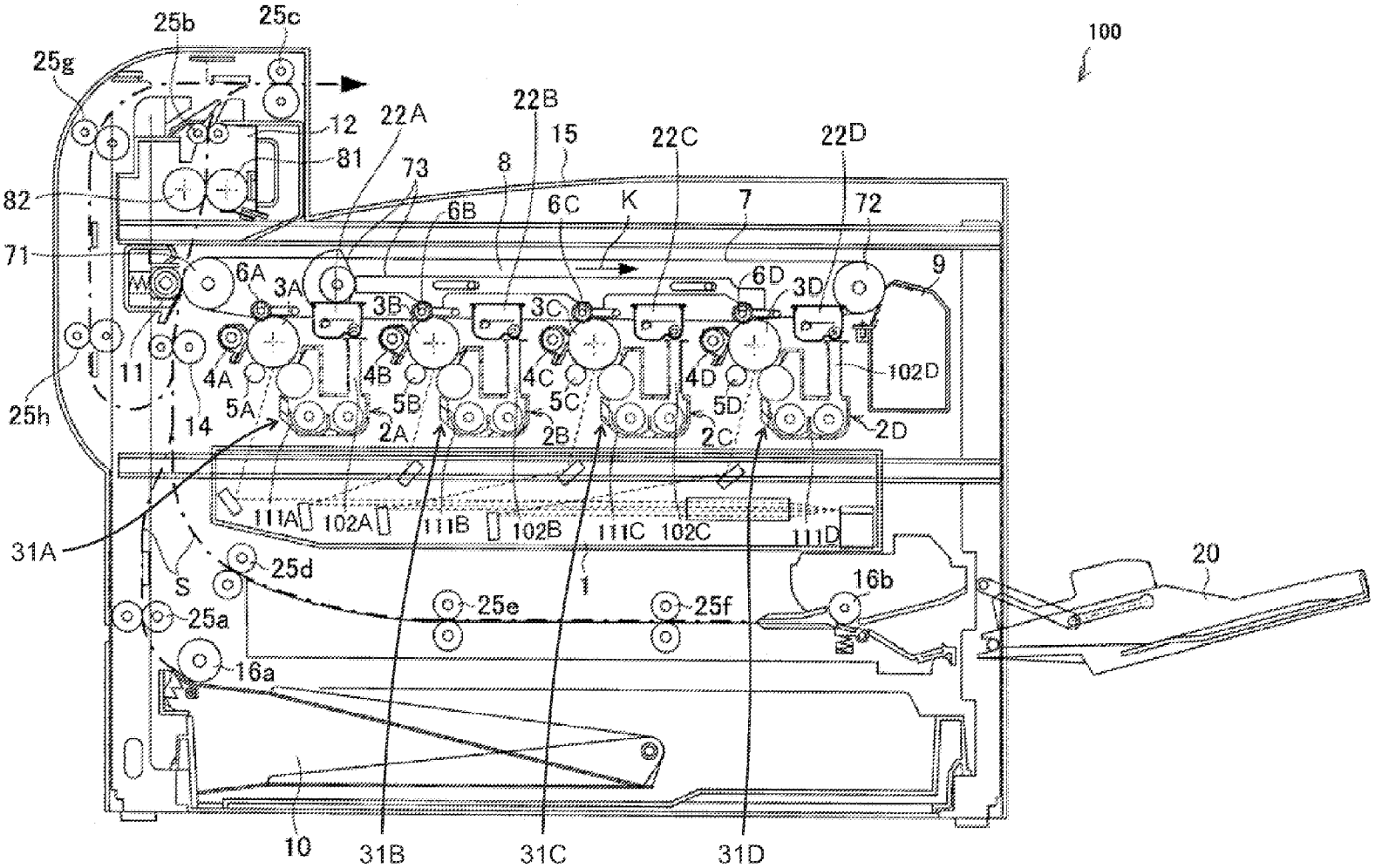
FIG. 2 is an explanatory view illustrating an entire arrangement of the image forming apparatus.

First, the following description deals with an entire configuration of an image forming apparatus employing a developing device in accordance with the present embodiment. FIG. 2 is a cross-sectional view schematically illustrating a configuration of an image forming apparatus 100 in accordance with the present embodiment. The image forming apparatus 100 forms an image by use of a toner in accordance with an electrophotographic technique.

The following embodiment describes a case where the image forming apparatus of the present invention is applied to a color-tandem-type image forming apparatus 100 for forming, in accordance with image data received from the outside, a multicolor image or a monochromatic image on a recording material, such as recording paper, a recording film, or a recording sheet. Note, however, that the present invention is not limited to this, and is applicable to any image forming apparatus, provided that it includes a developing device of the present invention which developing device will be described later as a developing device.

The image forming apparatus 100 includes an exposure unit (exposure device) 1, four image forming stations (image forming sections) 31A through 31D, an intermediate transfer belt unit (transfer device) 8, a transfer roller 11, a fixing unit (fixing device) 12, an internal paper feeding tray 10, a manual paper feeding tray 20, a sheet carrying path S, and a paper output tray 15 (see FIG. 2). Further, a scanner and the like can be additionally provided above the image forming apparatus 100. Note that each operation of the members provided in the image forming apparatus 100 is controlled by a main control section constituted by a CPU (not illustrated) and the like.

The image forming apparatus 100 forms a black image, a cyan image, a magenta image, and a yellow image by use of respective color components of black (K), cyan (C), magenta (M), and yellow (Y), and forms a color image by overlapping the images of the color components with each other.

Accordingly, the image forming apparatus 100 includes, for the images of the respective four color components, four developing devices 2 (2A, 2B, 2C, 2D), four photoreceptors (image bearing members) 3 (3A, 3B, 3C, 3D), four chargers (charging devices) 5 (5A, 5B, 5C, 5D), and four cleaner units 4 (4A, 4B, 4C, 4D) (see FIG. 2). In other words, for each of the color components CMYK, one image forming station 31 (31A, 31B, 31C, 31D) including one developing device 2, one photoreceptor 3, one charger 5, and one cleaner unit 4, is provided. Four toner images are formed by the respective image forming stations 31A through 31D, and are caused to overlap each other on the intermediate transfer belt 7.

Note that the sign "A" indicates a member for forming a black image, the sign "B" indicates a member for forming a cyan image, the sign "C" indicates a member for forming a magenta image, and the sign "D" indicates a member for forming a yellow image. Note that, in the present embodiment, members that (i) are provided for formation of the respective black, cyan, magenta, and yellow images but (ii) are identical with each other in function are not provided with the signs A through D but with only numbers, for the sake of simple explanation.

The image forming station 31 has an arrangement in which (i) the photoreceptor 3 is provided as being rotatable and (ii) the charger 5, the developing device 2, and the cleaner unit 4 are provided, in this order, along a periphery of the photoreceptor in a rotational direction of the photoreceptor 3.

The charger 5 uniformly charges an entire surface of the photoreceptor 3 at a certain electric potential. In addition to a contact-roller charger illustrated in FIG. 2, examples of the charger 5 encompass a contact-brush charger and a non-contact charger.

The developing device 2 (2A, 2B, 2C, 2D) carries out a developing process for making an electrostatic latent image formed on the surface of the photoreceptor 3 visible by use of a toner. The developing device 2 includes a toner transfer mechanism 102 (102A, 102B, 102C, 102D), a toner supply device 22 (22A, 22B, 22C, 22D), and a developing tank (developer container) 111 (111A, 111B, 111C, 111D).

The toner supply device 22 in which an unused toner (toner powder) is stored is provided above the developing tank 111. The toner is supplied from the toner supply device to the developing tank 111 via the toner transfer mechanism 102.

The cleaner unit 4 removes a residual toner that remains on the surface of the photoreceptor 3 after the toner image is transferred to the intermediate transfer belt 7, so as to collect the residual toner.

The exposure unit 1 causes the photoreceptor 3 charged by the charger 5 to be exposed in accordance with image data, so as to form an electrostatic latent image on a surface of the photoreceptor 3 in accordance with the image data. The exposure unit 1 is a laser scanning unit (LSU) including a laser illumination section and a reflecting mirror (see FIG. 2). Note, however, that, the exposure unit 1 is not limited to the laser scanning unit, and may be an EL (electroluminescence) element in which light emitting elements are arrayed, or an LED writing head. The exposure unit 1 causes the photoreceptor 3 charged by the charger 5 to be exposed in accordance with image data inputted into the image forming apparatus 100, so as to form an electrostatic latent image on the surface of the photoreceptor 3 in accordance with the image data.

The intermediate transfer belt unit 8 is provided above the photoreceptor 3. The intermediate transfer belt unit 8 includes intermediate transfer rollers 6 (6A, 6B, 6C, 6D), an intermediate transfer belt 7, an intermediate transfer belt driving roller 71, an intermediate transfer belt driven roller 72, an intermediate transfer belt tension mechanism 73, and an intermediate transfer belt cleaning unit 9.

The intermediate transfer rollers 6, the intermediate transfer belt driving roller 71, the intermediate transfer belt driven roller 72, and the intermediate transfer belt tension mechanism 73 are arranged so as to (i) cause the intermediate belt 7 to be in a tensioned state and (ii) drive the intermediate transfer belt 7 to rotate in a direction indicated by an arrow K shown in FIG. 2.

The intermediate transfer rollers 6 are rotatably held by respective intermediate transfer roller attachment sections of the intermediate transfer belt tension mechanism 73 of the intermediate transfer belt unit 8. A transfer bias voltage is applied to each of the intermediate transfer rollers so that a toner image formed on the corresponding photoreceptor 3 is transferred to the intermediate transfer belt 7.

The intermediate transfer belt 7 is in contact with the photoreceptor 3. Toner images for the respective color components, formed on the respective photoreceptors 3, are sequentially transferred onto the intermediate transfer belt 7 so that the toner images overlap each other. A color toner image (multicolor toner image) is formed in this manner. The intermediate transfer belt 7 is made of a film having a thickness in a range of 100 μm to 150 μm, for example, and has a shape having no ends.

The transfer of the toner image from the photoreceptor 3 to the intermediate transfer belt 7 is carried out by the intermediate transfer roller 6 that is in contact with a back surface of the intermediate transfer belt 7. The transfer bias voltage is applied to the intermediate transfer roller 6 so as to transfer the toner image to the intermediate transfer belt 7. The transfer bias voltage is a high voltage having a polarity (+) opposite to a polarity (−) of the charging of the toner.

The intermediate transfer roller 6 is formed such that (i) a metal (stainless steel, for example) shaft having a diameter in a range of 8 mm to 10 mm, for example, is provided as a base, and (ii) a surface of the metal shaft is covered with a conductive elastic material (e.g., an EPDM or urethane foam). The conductive elastic material allows the intermediate transfer roller 6 to uniformly apply a high voltage to the intermediate transfer belt 7. According to the present embodiment, the intermediate transfer roller 6 having a roller shape is used as a transfer electrode. Note, however, that the intermediate transfer roller 6 is not limited to this, and may have a brush shape.

As described above, electrostatic latent images formed on the respective the photoreceptors 3A through 3D are made visible by use of toners corresponding to the respective color components. In this manner, the toner images are generated. These toner images are caused to overlap and be stacked with each other on the intermediate transfer belt 7. The toner images stacked with each other are carried, by rotation of the intermediate transfer belt 7, to a contact position (transfer section) between a recoding material being carried and the intermediate transfer belt 7. The toner images are transferred onto the recording material at the contact position by the transfer roller 11 provided at the contact position. In this case, the intermediate transfer belt 7 and the transfer roller 11 are pressed against each other at a predetermined nip pressure, while a voltage for transferring the toner images to the recording material is applied to the transfer roller 11. The voltage is a high voltage having a polarity (+) opposite to a polarity (−) of the charging of the toner.

In order to maintain the predetermined nip pressure, one of the transfer roller 11 and the intermediate transfer belt driving roller 71 is made from a hard material such as a metal, while the other is made from an elastic material such as an elastic roller (e.g., an elastic rubber roller or a foamable resin roller).

The toner that has been attached to the intermediate transfer belt 7 by a physical contact between the intermediate transfer belt 7 and the photoreceptor 3 but has not been transferred to the recording material from the intermediate transfer belt 7 may cause a color mixture of toners in a subsequent step. Therefore, such a residual toner is removed and collected by the intermediate transfer belt cleaning unit 9.

The intermediate transfer belt cleaning unit 9 includes, for example, a cleaning blade that is in contact with the intermediate transfer belt 7. A back surface of the intermediate transfer belt 7 is supported by the intermediate transfer belt driven roller 72 at a position where the intermediate transfer belt 7 is in contact with the cleaning blade.

In the internal paper feeding tray 10, the recording material (the recording paper, the recording film, the recording sheet) on which an image is to be formed is stored. According to the present embodiment, the internal paper feeding unit tray 10 is provided below the image forming stations 31A through 31D and the exposure unit 1. Further, the manual paper feeding tray 20 is foldably provided on a side wall of the image forming apparatus 100. The manual paper feeding tray 20 is used when the recording material is fed manually. Meanwhile, the paper output tray 15 provided at an upper part of the image forming apparatus 100 is a tray to which a recording material on which an image has been formed is to be outputted.

Further, the image forming apparatus 100 includes a sheet carrying path S through which the recording material stored in the internal paper feeding tray 10 and the recording material fed to the manual paper feeding tray 20 are carried to the paper output tray 15 via the transfer section, the fixing unit 12, etc.

Further, the sheet carrying path S is provided with pickup rollers 16 (16*a*, 16*b*), a registration roller 14, the transfer section, the fixing unit 12, a plurality of carrying rollers 25 (25*a* through 25*h*), etc. Note that the transfer section is provided between the intermediate transfer belt driving roller 71 and the transfer roller 11.

Each of the plurality of carrying rollers 25 is a small roller for accelerating and supporting conveyance of the recording material, and is provided along the sheet carrying path S. The pickup roller 16*a* is provided at an end of the internal paper feeding tray 10. The pickup roller 16*a* is a suction roller for supplying the recording material one by one from the internal paper feeding tray 10 to the sheet carrying path S. The pickup roller 16*b* is provided in the vicinity of the manual paper feeding tray 20. The pickup roller 16*b* is a suction roller for supplying the recording material one by one from the manual paper feeding tray 20 to the sheet carrying path S. The registration roller 14 (i) temporarily holds the recording material being carried through the sheet carrying path S, and (ii) supplies the recording material to the transfer section at timing that an end of a toner image formed on the intermediate transfer belt 7 and an end of the recording material match each other.

The fixing unit 12 includes a heat roller 81 and a pressure roller 82. The heat roller 81 and the pressure roller 82 sandwich the recording sheet and rotate. The heat roller 81 is controlled to be at a predetermined fixing temperature by a control section (not illustrated). The control section controls the temperature of the heat roller 81 on the basis of a detection signal received from a thermometer (not illustrated).

The heat roller 81 carries out, in combination with the pressure roller 82, thermocompression with respect to the recoding material so that the toner images of the respective color components are melt, mixed with each other, and attached to the recording material with pressure. Heat-fixing of the toner images to the recording material is thus carried out. Note that the recording material on which the toner images of the respective color components (color toner images) are fixed is carried to an inversion paper output path of the sheet carrying path S by the plurality of the carrying rollers 25, and then is inverted (state where the multicolor toner image faces downward), after that, is outputted to the paper output tray 15 in the inverted state.

Next, the following description deals with how a recording material carrying operation is carried out by the sheet carrying path S.

The following description deals with one-side printing. The recording material supplied from the internal paper feeding tray 10 is picked up by the pickup roller 16*a*, and then is carried to the registration roller 14 by the carrying roller 25*a* in the sheet carrying path S, after that, is supplied to the transfer section (the contact position between the transfer roller 11 and the intermediate transfer belt 7) by the registration roller 14 at timing that an end of the recording material and an end of each of the toner images stacked with each other match each other. The toner images are transferred to the recording sheet at the transfer section, and are fixed on the recording material by the fixing unit 12. Then, the recording material is carried by the carrying roller 25*b*, and then outputted to the paper output tray 15 by the paper output roller 25*c*.

Further, the recording material supplied from the manual paper feeding tray 20 is picked up by the pickup roller 16*b*, and then is carried to the registration roller 14 by the plurality of carrying rollers 25 (25*f*, 25*e*, 25*d*). After being carried to the registration roller 14, the recording material is subjected to the printing and then outputted to the paper output tray 15 in the same manner as the recording material supplied from the internal paper feeding tray 10.

On the other hand, in a case of two-sided printing, the recording material is, first, subjected to the one-side printing as described above, and then is received by the paper output roller 25*c* from the fixing unit 12. A rear end of the recording material is chucked by the paper output roller 25*c*, and then the recording material is led to the carrying rollers 25*g* and 25*h* by inverse rotation of the paper output roller 25*c*. After that, the recording material is carried to the registration roller 14 again, and then is subjected to the printing process for its surface opposite to the surface that has been subjected to the printing. Ultimately, the recording material is outputted to the paper output tray 15.

Next, the following description deals with details of a configuration of the toner supply device 22.

Figure 3:
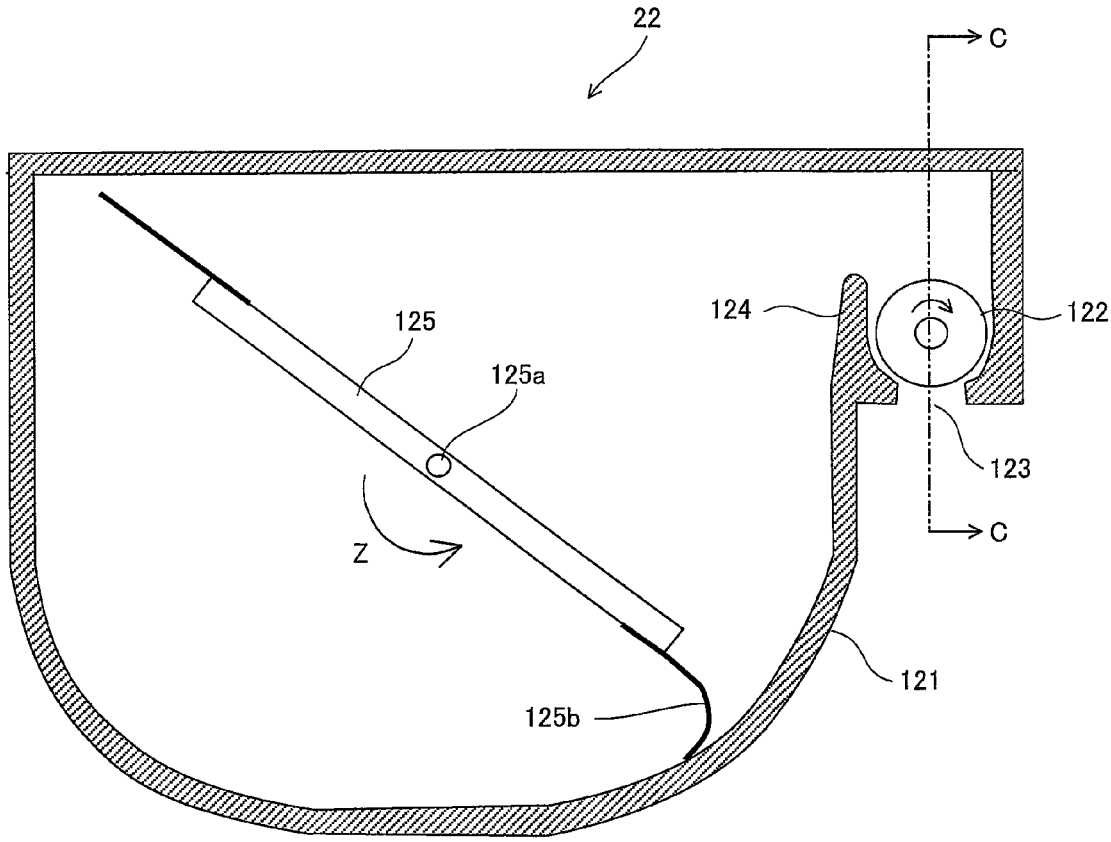
FIG. 3 is a cross-sectional view schematically illustrating a configuration of a toner supply device included in the image forming apparatus.
Figure 4:
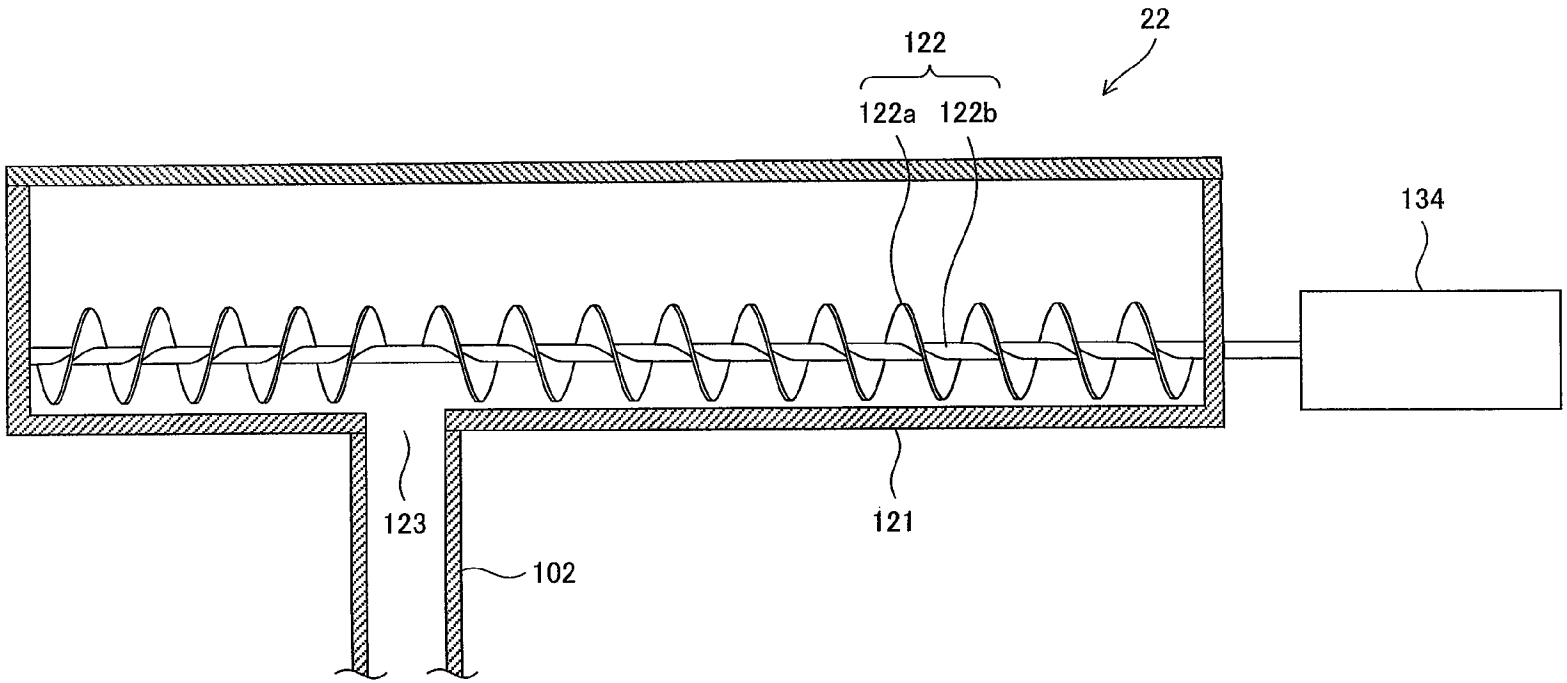
FIG. 4 is a cross-sectional view illustrating the toner supply device illustrated in FIG. 3, taken along the line C-C.

FIG. 3 is a cross-sectional view schematically illustrating the configuration of the toner supply device 22 of the image forming apparatus 100, and FIG. 4 is a cross-sectional view taken along the line C-C shown in FIG. 3.

The toner supply device 22 includes a toner container 121, a toner-stirring member 125, a toner discharge member 122, and a toner discharge opening 123 (see FIG. 3). The toner supply device 22 in which an unused toner (toner powder) is stored is provided above the developing tank 111. The unused toner stored in the toner supply device 22 is supplied, by rotation of the toner discharge member (output screw) 122, to the developing tank 111 via the toner discharge opening 123 and the toner transfer mechanism 102.

The toner container 121 is a container having a columnar shape whose base has a shape substantially identical with a half circle, which columnar shape has an internal space. The toner container 121 has the toner-stirring member 125 and the toner discharge member 122 so that the toner-stirring member 125 and the toner discharge member 122 are rotatable. A toner is stored in the toner container 121. The toner discharge opening 123 is an opening whose shape is substantially identical with a rectangle. The discharge opening 123 is formed (i) below the toner discharge member 122 and (ii) in the vicinity of a center of the toner discharge member 122 in an axial direction of the toner discharge member 122, so as to face the toner transfer mechanism 102.

The toner-stirring member 125 is a plate member which rotates around a rotary shaft 125*a* so as to scoop the toner stored in the toner container 121 up to the toner discharge member 122 while stirring the toner. The toner-stirring member 125 has toner-scooping members 125*b* at its ends, respectively. The toner-scooping members 125*b* are made of, for example, a material having flexibility such as a polyethylene terephthalate (PET), and are attached to respective ends of the toner-stirring member 125.

The toner discharge member 122 supplies the toner stored in the toner container 121 to the developing tank 111 via the toner discharge opening 123. The toner discharge member 122 is constituted by a screw auger including a toner carrying blade 122*a* and a toner discharge member rotary shaft 122*b* (see FIG. 4). The toner discharge member 122 can be driven to rotate by a toner discharge member driving motor 134. The toner carrying blade 122*a* of the screw auger is arranged so that the toner is moved toward the toner discharge opening 123 from both ends of the toner discharge member 122 in the axial direction of the toner discharge member 122.

A toner discharge member blocking wall 124 is provided between the toner discharge member 122 and the toner-stirring member 125. With the arrangement, the toner scooped up by the toner-stirring member 125 is adjusted in an amount so that an appropriate amount of the toner is retained around the toner discharge member 122.

The toner-stirring member 125 rotates in a Z direction shown in FIG. 3 so as to stir the toner and scoop up the toner toward the toner discharge member 122. Here, the toner-scooping members 125*b* have flexibility so as to change their shapes, as sliding along an internal wall of the toner container 121. With the arrangement, the toner scooping members 125*b* can supply the toner toward the toner discharge member 122. The toner discharge member 122 rotates so as to lead the supplied toner to the toner discharge opening 123.

<Developing Device>

Figure 1:
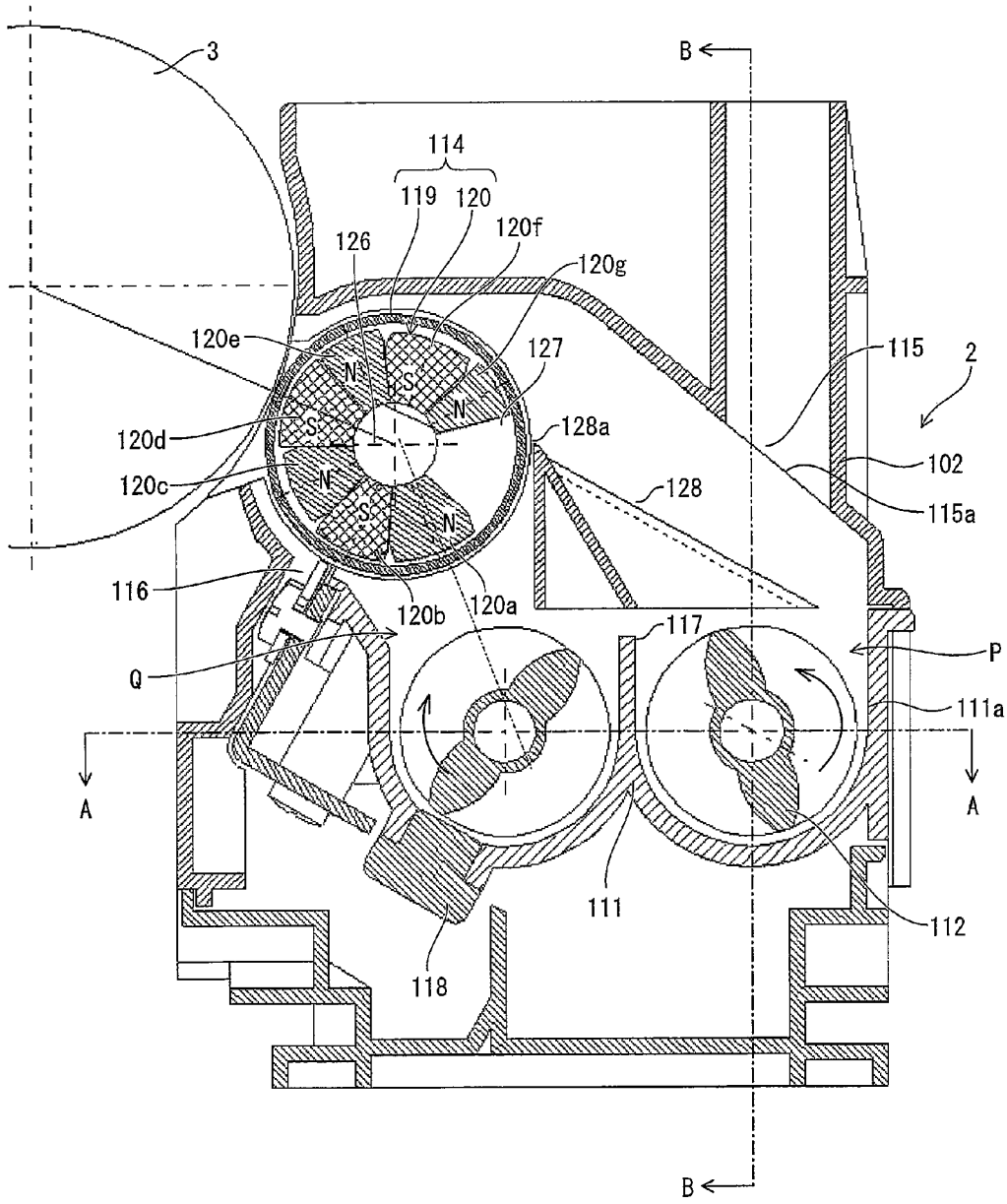
FIG. 1 is a cross-sectional view illustrating a configuration of a developing device included in an image forming apparatus in accordance with an embodiment of the present invention.
Figure 5:
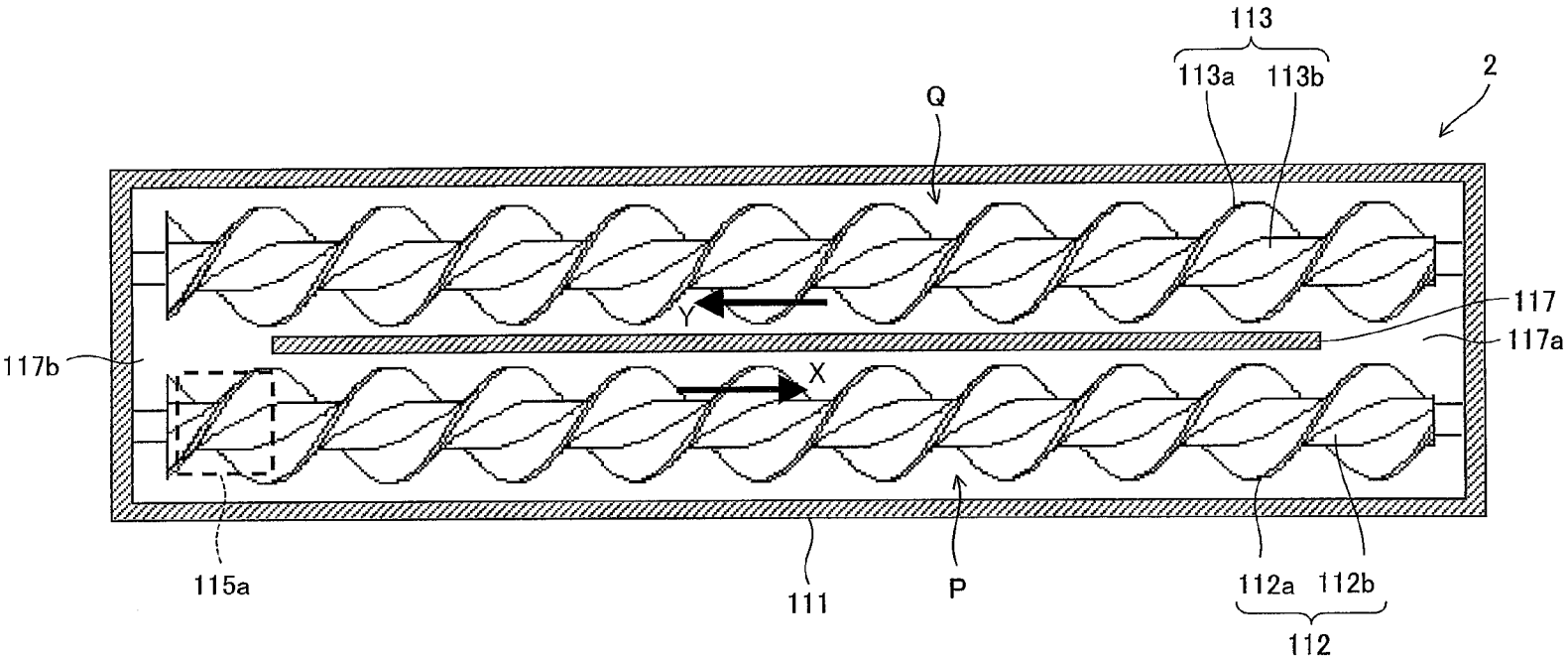
FIG. 5 is a cross-sectional view illustrating the developing device illustrated in FIG. 1, taken along the line A-A.
Figure 6:
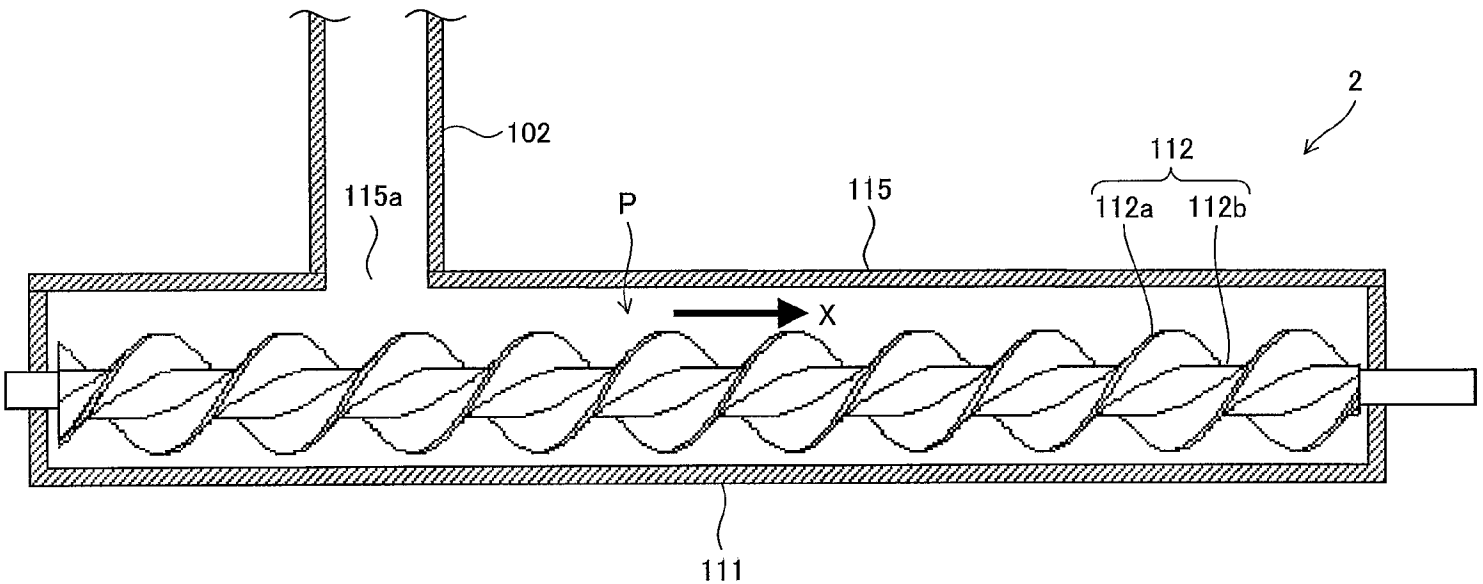
FIG. 6 is a cross-sectional view illustrating the developing device illustrated in FIG. 1, taken along the line B-B.

Next, the following description deals with a characteristic developing device 2 in accordance with the present embodiment, with reference to drawings. FIG. 1 is a cross-sectional view illustrating a configuration of the developing device 2 of the present embodiment, included in the image forming apparatus 100 of the present embodiment. FIG. 5 is a cross-sectional view taken along the line A-A shown in FIG. 1, and FIG. 6 is a cross-sectional view taken along the line B-B shown in FIG. 1.

The developing device 2 includes a developing roller 114 which is provided in the developing tank 111 to face the photoreceptor 3 (see FIG. 1). The developing device 2 supplies, by use of the developing roller 114, a toner to the surface of the photoreceptor 3, so as to make an electrostatic latent image formed on the surface of the photoreceptor 3 visible (developed).

In addition to the developing roller 114 and the developing tank 111, the developing device 2 includes a developing tank cover (upper wall) 115, a toner supply opening 115*a*, a doctor blade 116, a first carrying member 112, a second carrying member 113, a partition wall (first side wall) 117, and a permeability sensor 118.

The developing tank 111 is a tank for storing a two-component developer including a toner and a carrier (hereinafter, merely referred to as "developer" for the sake of simple explanation). In the developing tank 111, the developing roller 114, the first carrying member 112, the second carrying member 113, and the like are provided.

Note that the carrier used in the present embodiment is a magnetic carrier having magnetism. Specific examples of magnetic particles encompass metal particles such as particles of iron, ferrite, or magnetite, and particles of an alloy of such a metal and a metal such as aluminum or lead. Among these, ferrite particles are particularly preferable. Alternatively, the magnetic particles can be a resin coating carrier in which magnetic particles are coated with a resin, a resin dispersed carrier in which magnetic particles are dispersed in a resin, or the like.

Further, the developing tank cover 115 is provided detachable at an upper part of the developing tank 111 (see FIG. 1). Furthermore, the developing tank cover 115 has a toner supply opening 115*a* via which an unused toner is supplied into the developing tank 111. The toner supply opening 115*a* is connected to the toner transfer mechanism 102 of the toner supply device 22. Accordingly, the unused toner stored in the toner supply device 22 is transferred into the developing tank 111 via the toner transfer mechanism 102 and the toner supply opening 115*a*. The unused toner is supplied into the developing tank 111 in this manner.

In the developing tank 111, the partition wall 117 is provided between the first carrying member 112 and the second carrying member 113 (see FIGS. 1 and 5). The partition wall 117 extends in parallel with (i) an axial direction (a direction in which the rotary shaft extends) of the first carrying member 112 and (ii) an axial direction (a direction in which the rotary shaft extends) of the second carrying member 113. The partition wall 117 partitions an internal space of the developing tank 111 into a first carrying path P in which the first carrying member 112 is provided and a second carrying path Q in which the second carrying member 113 is provided. In the present embodiment, the partition wall (first side wall) 117 and a side wall (second side wall) 111*a* of the developing tank 111 define a space corresponding to the first carrying path P.

The partition wall 117 is provided so that both ends of the partition wall 117 in the axial direction of the first carrying member 112 and the second carrying member 113 are not in contact with any internal side wall of the developing tank 111 (see FIG. 5). That is, in the vicinity of each of the ends of the partition wall 117 in the axial direction of the first carrying member 112 and the second carrying member 113, there is a communicating path via which the first carrying path P and the second carrying path Q are connected. Hereinafter, a communicating path formed on a downstream side of the first carrying path P (downstream in a direction indicated by an arrow X) is referred to as "first communicating path 117*a*," whereas a communicating path formed on a downstream side of the second carrying path Q (downstream in a direction indicated by an arrow Y) is referred to as "second communicating path 117*b*".

The first carrying member 112 and the second carrying member 113 are provided such that (i) their outer surfaces face each other via the partition wall 117 and (ii) their axes are parallel to each other. The first carrying member 112 and the second carrying member 113 are set to rotate in inverse directions with respect to each other. Therefore, the first carrying member 112 and the second carrying member 113 carry the developer in the directions opposite to each other, respectively, while stirring the developer. The first carrying member 112 carries the developer in the direction indicated by the arrow X, whereas the second carrying member 113 carries the developer in the direction indicted by the arrow Y, which is opposite to the direction indicated by the arrow X (see FIG. 5).

As described above, the developing device 2 is a circulation-type developing device in which the developer is circulated through the first carrying path P and the second carrying path Q.

The first carrying member 112 is constituted by a screw auger including a first spiral carrying blade 112*a* and a first rotary shaft 112*b* (see FIG. 5). Similarly, the second carrying member 113 is constituted by a screw auger including a second spiral carrying blade 113*a* and a second rotary shaft 113*b*. The first carrying member 112 and the second carrying member 113 are driven by driving means such as a motor (not illustrated) so as to rotate. By the rotation of the first carrying member 112 and the second carrying member 113, the developer is stirred and carried.

The developing roller 114 is provided to face, but not in contact with, the photoreceptor 3 (with a space between them) (see FIG. 1). The developer carried by the developing roller 114 is in contact with the photoreceptor 3 at an area where the developing roller 114 and the photoreceptor 3 are closest to each other. The contact area serves as a developing area (developing nip section). In the developing area, a developing bias voltage is applied to the developing roller 114 from a power source (not illustrated) connected to the developing roller 114, so that the toner is supplied from the developer on the surface of the developing roller 114 to an electrostatic latent image formed on the surface of the photoreceptor 3.

The developing roller 114 includes a developing sleeve 119 and a magnet roller 120 (see FIG. 1). The developing roller 114 (i) scoops the developer in the developing tank 111 to the surface of the developing sleeve 119 by magnetic force of the magnet roller 120, (ii) holds (captures) the developer on the surface of the developing sleeve 119, and then (iii) supplies the toner contained in the developer held on the surface of the developing sleeve 119 to the photoreceptor 3.

The developing sleeve 119 is a circular cylinder member that (i) is made of a nonmagnetic material such as aluminum or stainless steel and (ii) constitutes a periphery part of the developing roller 114. The developing sleeve 119 rotates in one direction (a clockwise direction in FIG. 1) on an outer surface of the magnet roller 120, so as to carry the developer while holding the developer by the magnetic power of the magnet roller 120.

According to the present embodiment, the magnet roller 120 is formed such that 7 magnetic poles (a first magnetic pole 120*a* through a seventh magnetic pole 120*g*) are fixed to a magnet fixing shaft 126. That is, the seven magnetic poles are provided integral with each other.

The first magnetic pole 120*a* is positioned so as to face the developer that is stirred and carried in the developing tank 111. Specifically, the first magnetic pole 120*a* is provided so as to face the second carrying member 113. The first magnetic pole 120*a* is a scooping magnetic pole for scooping, to the developing sleeve 119, the developer that is stirred and carried by the second carrying member 113 (causing the developer to be captured by (absorbed to) the developing sleeve 119). According to the present embodiment, the first magnetic pole 120*a* is constituted by the north pole. Note that the scooping magnetic pole 120*a* can be the south pole provided that the north poles and the south poles are arranged alternately so that neighboring poles of the first magnetic pole 120*a* through the seventh magnetic pole 120*g* are opposite to each other in polarity. Furthermore, the number of the magnetic poles is not limited to 7, and can be 5, for example.

During a normal image forming operation, first, the developer provided in the developing tank 111 is scooped toward the developing roller 114 by use of a magnetic line created by the first magnetic pole 120*a*.

The second magnetic pole 120*b* is provided adjacent to the first magnetic pole 120*a* on a downstream side in the rotational direction of the developing sleeve 119 (the clockwise direction in FIG. 1). The second magnetic pole 120*b* is the south pole. The second magnetic pole 120*b* is provided so that the magnetic power of the second magnetic pole 120*b* is substantially strongest in an area where a surface of the developing sleeve 119 faces the doctor blade 116. The developer is scooped up to the surface of the developing sleeve 119 by use of a magnetic line created by the second magnetic pole 120*b*, and then is stably carried to downstream in the rotational direction of the developing sleeve 119. A layer thickness of the developer carried on the surface of the developing sleeve 119 is made uniform by the doctor blade 116.

The third magnetic pole 120*c* is provided adjacent to the second magnetic pole 120*b* on the downstream side in the rotational direction of the developing sleeve 119. The third magnetic pole 120*c* is the north pole. A magnetic line created by the third magnetic pole 120*c* contributes to stable conveyance of the developer on the developing sleeve 119 from the third magnetic pole 120*c* to the downstream forth magnetic pole 120*d* in the rotational direction of the developing sleeve 119, which developer has been made uniform in thickness by the doctor blade 116.

The fourth magnetic pole 120*d* is provided adjacent to the third magnetic pole 120*c* on the downstream side in the rotational direction of the developing sleeve 119. The fourth magnetic pole 120*d* is the south pole. The fourth magnetic pole is provided to face the photoreceptor 3, and serves as a main magnetic pole to form an image. The developer carried from the third magnetic pole 120*c* is slid against the photoreceptor 3 by a magnetic brush of the developer, which magnetic brush is created by a magnetic line of the fourth magnetic pole 120*d*. The area where (i) the magnetic brush is created and (ii) the photoreceptor 3 and the developing sleeve 119 face each other is the developing area.

The fifth magnetic pole 120*e* is provided adjacent to the fourth magnetic pole 120*d* on the downstream side in the rotational direction of the developing sleeve 119. The fifth magnetic pole 120*e* is the north pole. The developer carried from the position of the fourth magnetic pole 120*d* is held by the developing sleeve 119 by use of a magnetic line created by the fifth magnetic pole 120*e*, and then further carried toward downstream in the rotational direction of the developing sleeve 119.

The sixth magnetic pole 120*f* is provided adjacent to the fifth magnetic pole 120*e* on the downstream side in the rotational direction of the developing sleeve 119. The sixth magnetic pole 120*f* is the south pole. The developer carried from the position of the fifth magnetic pole 120*e* is held by the developing sleeve 119 by use of a magnetic line created by the sixth magnetic pole 120*f*, and then further carried to downstream in the rotational direction of the developing sleeve 119.

The seventh magnetic pole 120*g* is provided adjacent to the sixth magnetic pole 120*f* on the downstream side in the rotational direction of the developing sleeve 119. The seventh magnetic pole 120*g* is the north pole. The seventh magnetic pole is identical with the first magnetic pole 120*a* in polarity (according to the present embodiment, the north pole). No magnetic pole is provided in an area 127, on the developing sleeve 119, between the seventh magnetic pole 120*g* and the first magnetic pole 120*a*, and therefore no magnetic line is created in the area 127. Accordingly, the developer held by the seventh magnetic pole 120*g* is released from the developing sleeve 119 in the area 127. For this reason, the area 127 is referred to as "developer releasing region 127".

According to the present embodiment, the developer (residual developer) released from the developing sleeve 119 in the developer releasing region 127 is moved toward a sliding member (developer collecting guide member) 128.

The sliding member 128 is provided, in the developing tank 111, downstream from the developing area in the rotational direction of the developing roller 114. The sliding member 128 leads, by use of its inclined plane, the developer (residual developer) that remains on the surface of the developing roller 114 from the developing roller 114 toward the first carrying path P.

Figure 7:
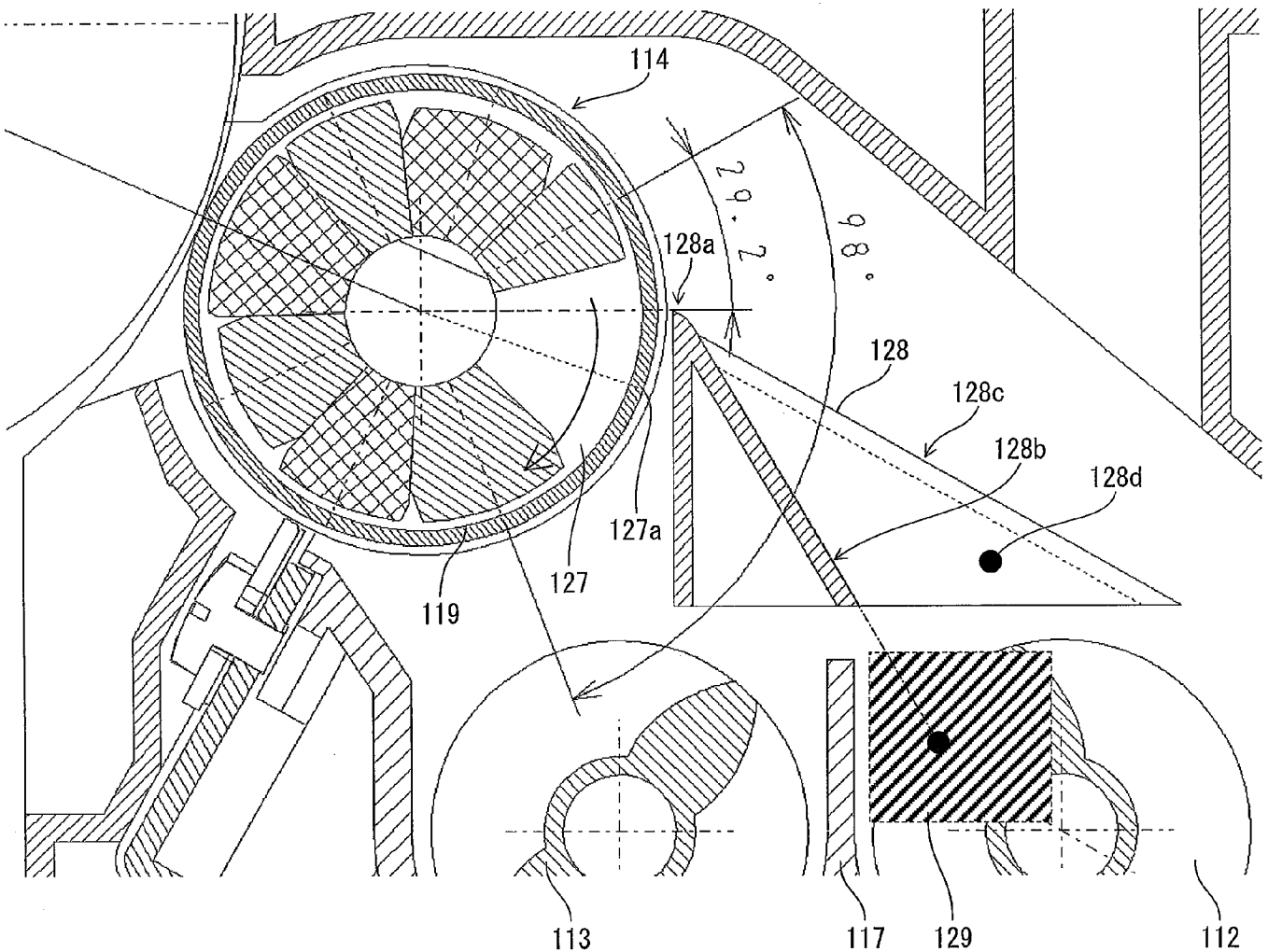
FIG. 7 is an enlarged view of a cross section of a portion of the developing device illustrated in FIG. 1 which portion corresponds to a sliding member and its vicinity.
Figure 8:
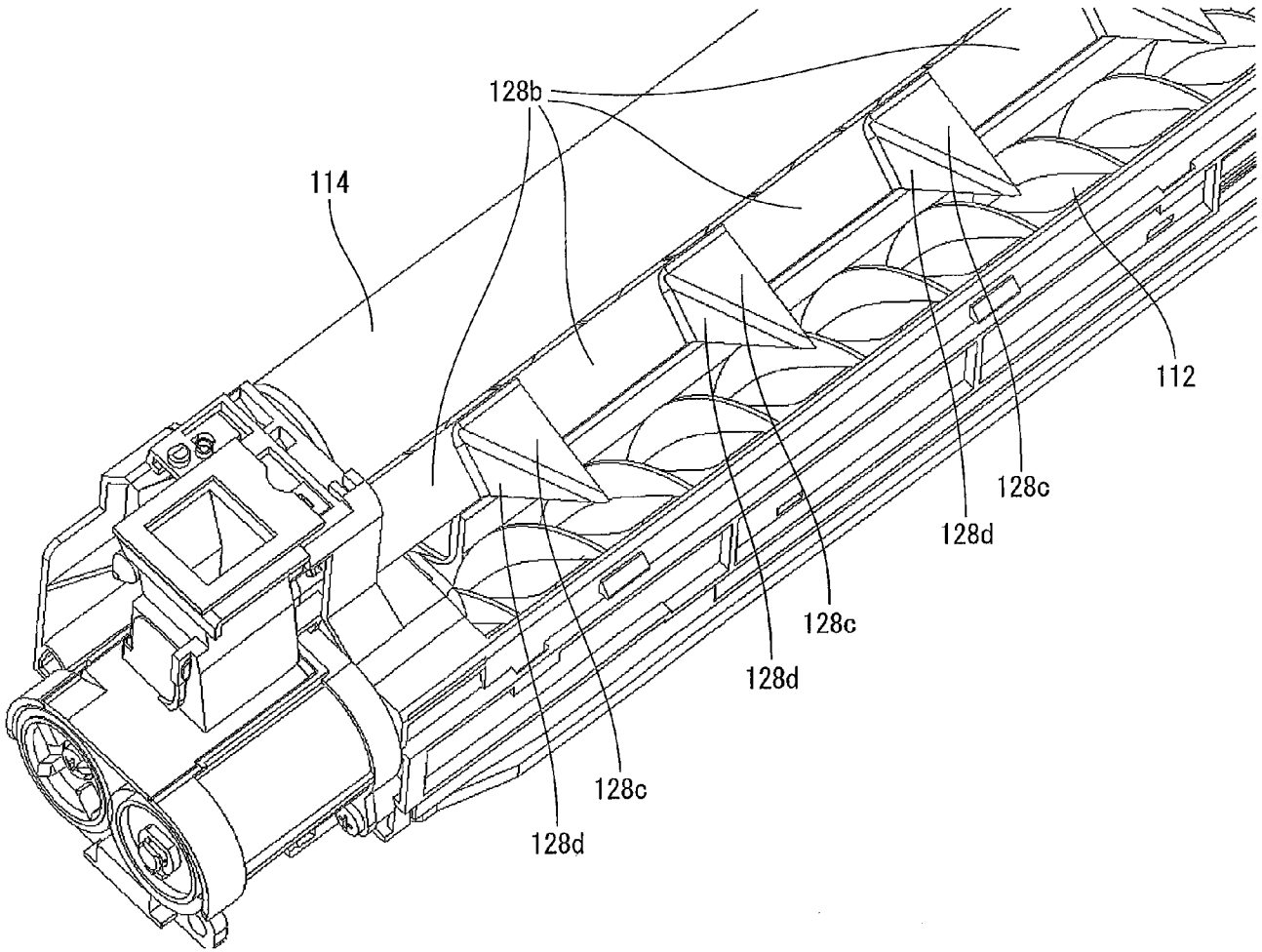
FIG. 8 is a perspective view illustrating the portion of the developing device illustrated in FIG. 1 which portion corresponds to a sliding member and its vicinity.
Figure 9:
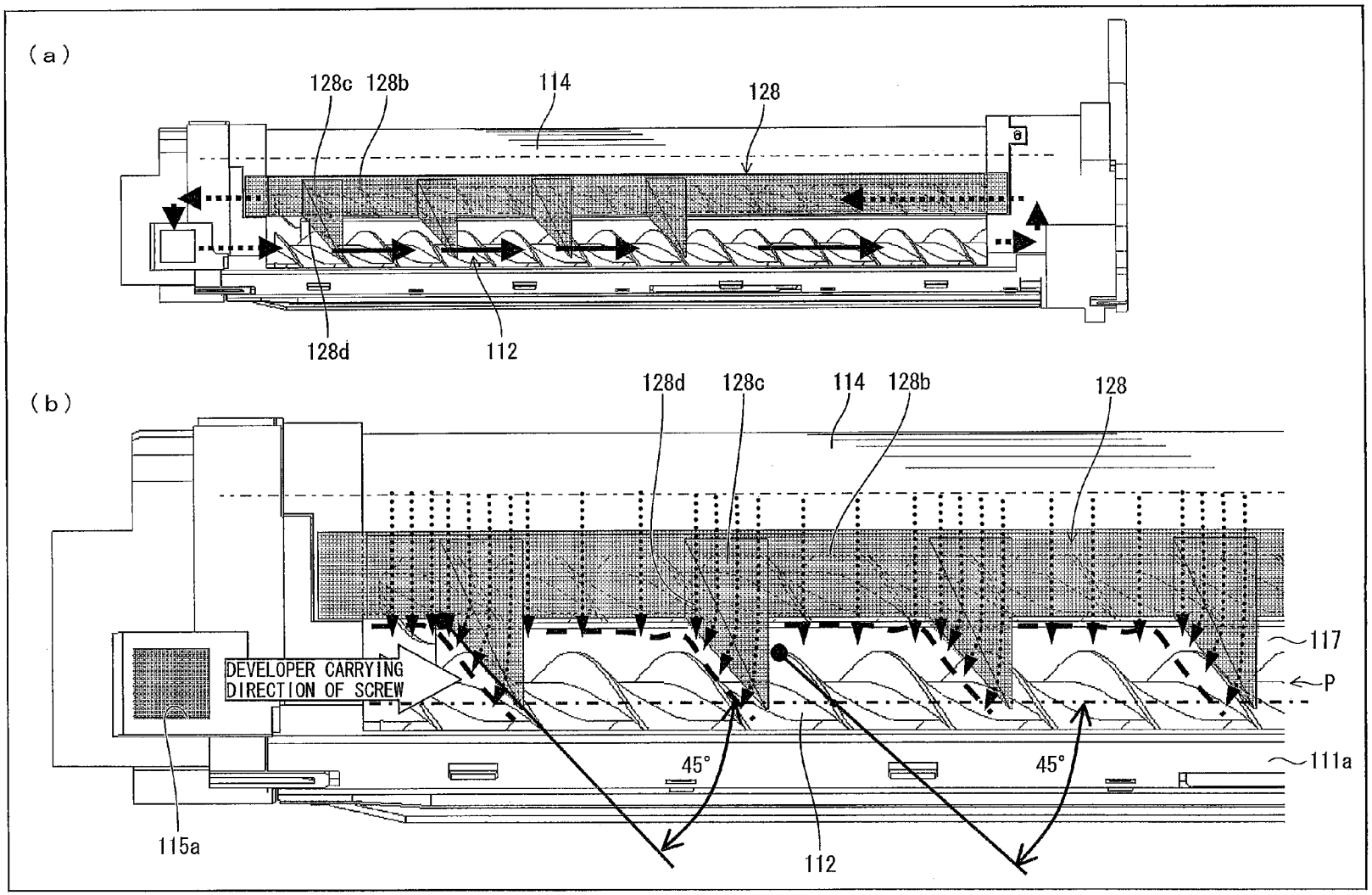
FIG. 9*a* is a plan view illustrating how developer is carried in a first carrying path and a second carrying path of the developing device illustrated in FIG. 1.
FIG. 9*b* is a plan view illustrating how a collected developer is carried.

As illustrated in FIGS. 7, 8, 9(*a*), and 9(*b*), the sliding member 128 includes a first inclined plane 128*b* and a second inclined plane 128*c*. FIG. 7 is an enlarged view of a cross section of a portion of the developing device 2 which portion corresponds to the sliding member 128 and its vicinity. The residual developer on the surface of the developing roller 114 is scraped off by the collection section 128*a* of the sliding member 128 as illustrated in FIG. 7, and is then moved (carried) to the first inclined plane 128*b* and the second inclined plane 128*c* of the sliding member 128 as illustrated in FIG. 9(*b*). As described above, the collection section 128*a* of the sliding member 128 is a start-end section, in which the sliding member 128 starts carrying the residual developer.

The first inclined plane 128*b* guides the residual developer to a position in the first carrying path P which position is between the partition member (first side wall) 117 and the rotary shaft (first rotary shaft 112*b*) of the first carrying member 112. The second inclined plane 128*c* has an angle of inclination which angle is smaller than an angle of inclination of the first inclined plane 128*b*, and guides the residual developer to the first carrying path P. Further, as illustrated in FIGS. 8, 9(*a*), and 9(*b*), the second inclined plane 128*c* has an end section present downstream in a direction in which the residual developer is guided, the end section reaching a position between the side wall 111*a* (second side wall) of the developing tank 111 and the rotary shaft (first rotary shaft 112*b*) of the first carrying member 112. The second inclined plane 128*c* tapers in area to the end section.

As described above, the residual developer on the surface of the developing roller 114 is guided to the first carrying path P by via the first inclined plane 128*b* and the second inclined plane 128*c*.

Since the second inclined plane 128*c* tapers in area to the end section, the residual developer carried via the second inclined plane 128*c* hardly reaches the end section, and instead drops from either side of the second inclined plane 128*c*. Such a residual developer dropping from the sides is consequently guided to the first carrying path P in a direction bent from an inclination direction of the second inclined plane 128*c*. The present embodiment includes a third inclined plane 128*d* provided continuously from the second inclined plane 128*c* as described below. The residual developer dropping from the sides of the second inclined plane 128*c* is guided to the first carrying path P along the third inclined plane 128*d* in a direction bent from the inclination direction of the second inclined plane 128*c*.

The second inclined plane 128*c* has an angle of inclination which angle is smaller than the angle of inclination of the first inclined plane 128*b*, and tapers in area to an end section in the direction in which the residual developer is guided, the end section reaching a position between the side wall 111*a* and the rotary shaft of the first carrying member 112.

With the above arrangement, the residual developer carried via the second inclined plane 128*c* drops over and across the first carrying member 112 in a cross section taken along a direction from the partition member 117 to the side wall 111*a*. In other words, the residual developer carried along the second inclined plane 128*c* and dropping therefrom forms a hook-shaped curtain over and across the first carrying member 112.

The above arrangement allows the residual developer guided via the first inclined plane 128*b* and the second inclined plane 128*c* to hold down supplied toner in the first carrying path P while the toner is mixed with developer. The above arrangement thus accelerates the mixing of toner with developer. The residual developer guided via the second inclined plane 128*c* is guided to the first carrying path P in a bent direction as described above. This further improves efficiency in the mixing of toner with developer.

The developing device 2 of the present embodiment, as described above, accelerates the mixing of toner with developer and the stirring of developer, and consequently supplies sufficiently charged toner to the developing roller 114. As such, it is possible to reduce problematic toner scattering and photographic fog.

As illustrated in FIGS. 7, 8, 9(*a*), and 9(*b*), the sliding member 128 of the present embodiment includes a third inclined plane 128*d* for guiding to the first carrying path P a residual developer carried along the second inclined plane 128*c*. The third inclined plane 128*d* has a start-end section for receiving the residual developer from the second inclined plane 128*c*, the start-end section coinciding with a side of the second inclined plane 128*c* which side is present upstream in a direction in which the first carrying member 112 carries developer. Further, the third inclined plane 128*d* has a rear-end section from which the above residual developer is dropped, the rear-end section (i) being located vertically above the first carrying member 112 and (ii) having a predetermined angle with respect to the first rotary shaft 112*b*, that is, the rotary shaft of the first carrying member 112.

In a case where the residual developer carried via the second inclined plane 128*c* is then carried along the third inclined plane 128*d* and drops therefrom to the first carrying path P, it is possible to guide the residual developer to the first carrying path P without diffusing the residual developer. As such, the developing device 2 further improves efficiency in the mixing of toner with developer.

The developing device 2 of the present embodiment includes two carrying paths, namely the first carrying path P and the second carrying path Q. The above advantage is, however, achievable regardless of the number of carrying paths as long as a member for guiding a residual developer to a carrying path to which toner is supplied is identical in configuration to the sliding member 128 of the present embodiment.

As illustrated in FIGS. 8, 9(*a*), and 9(*b*), the first inclined plane 128*b* has an end section (rear-end section) present downstream in a direction in which the residual developer is guided on the first inclined plane 128*b*, the end section being positioned vertically above the partition member 117 and extending along a longitudinal direction of the partition member 117. With this arrangement, the developer guided via the first inclined plane 128*b* allows toner suspended in a carrying path to effectively mix with developer in the first carrying path P. Further, it is possible to prevent toner from scattering to the outside of the first carrying path P.

The collection section 128*a* of the sliding member 128 is, as illustrated in FIG. 1, provided facing the developing roller 114 at such a position as to (i) correspond to the developer releasing region 127 and (ii) be upstream in the rotational direction of the development sleeve 119 from a position which halves an angle formed, with use of the magnet fixing shaft 126 of the developing roller 114 as a center, by the two magnetic poles sandwiching the developer releasing region 127 (namely, the first magnetic pole 120*a* and the seventh magnetic pole 120*g*). In a case where the collection section 128*a* is provided so as to face the developing roller 114 as above, it is possible to suppress (i) a change in carrying power (speed) and (ii) stress on the developer when the residual developer on the surface of the developing roller 114 is transferred (collected) to the sliding member 128.

The collection section 128*a* of the sliding member 128 corresponds to an uppermost section (start-end section) of the first inclined plane 128*b*. In other words, the first inclined plane 128*b* is a plane circumscribed with the developing roller 114. The collection section 128*a* can alternatively be described as present on an imaginary extended plane of the first inclined plane 128*b*. Further, the second inclined plane 128*c* has an uppermost section (start-end section) which is present downstream, in a direction in which the residual developer is carried on the first inclined plane 128*b*, from the uppermost section (start-end section) of the first inclined plane 128*b*.

This arrangement suppresses a change in carrying power (speed) when the residual developer on the surface of the developing roller 114 is transferred (collected) to the first inclined plane 128*b*. The arrangement thus allows the first inclined plane 128*b* and the second inclined plane 128*c* to evenly carry the residual developer.

The first inclined plane 128*b* has an end section (rear-end section) present downstream in the direction in which the residual developer is guided on the first inclined plane 128*b*, the end section having a side that guides the residual developer to a partition wall side upper surface region 129 (indicated by a second quadrant in FIG. 7). The partition wall side upper surface region is a region in the first carrying path P which region is present between the partition member (first side wall) 117 and the rotary shaft (first rotary shaft 112*b*) of the first carrying member 112. The first inclined plane 128*b* is thus an inclined plane which connects the developer releasing region 127 with the partition wall side upper surface region 129.

As illustrated in the perspective view of FIG. 8, the second inclined plane 128*c* tapers in area, at a side present upstream in the direction in which the first carrying member 112 carries developer, to an end section of the second inclined plane 128*c* which end section is present downstream in the direction in which the residual developer is guided on the second inclined plane 128*c*. In other words, the second inclined plane 128*c* tapers in area to the end section (that is, downstream) at a side. The second inclined plane 128*c* shaped as such effectively achieves the above bent direction for the residual developer.

The second inclined plane 128*c* can alternatively taper in area to an end section which is present downstream in the direction in which the first carrying member 112 carries developer. However, in the case where the second inclined plane 128*c* tapers in area, as illustrated in FIG. 8, to the end section which is present upstream in the direction in which the first carrying member 112 carries developer, the residual developer drops in such a direction as to face the direction in which the first carrying member 112 carries developer. The above arrangement thus more effectively allows toner which is suspended, such as supplied toner, to mix with developer.

The third inclined plane 128*d*, as illustrated in FIGS. 8, 9(*a*), and 9(*b*), has a triangular shape and has a start-end section having a side which coincides with a side of an end section (rear-end section) of the second inclined plane 128*c*. The second inclined plane 128*c* in combination with the third inclined plane 128*d* thus forms a projection in a shape of a substantial triangular pyramid. This shape allows a residual developer which has been carried to the second inclined plane 128*c* to drop via the second inclined plane 128*c* and along the third inclined plane 128*d* to the first carrying path P.

The sliding member 128 of the present embodiment includes four sets of the second inclined plane 128*c* and the third inclined plane 128*d*, the four sets being spaced from one another in the direction in which the first carrying member 112 carries developer. In other words, the first inclined plane 128*b* is provided with four projections each including the second inclined plane 128*c* and the third inclined plane 128*d*. The number of the projection is not limited as such. In a case where a plurality of the projection or the second inclined plane 128*c* is provided, it is possible to accelerate the mixing of toner with developer at positions at which the plurality of the projection or the second inclined plane 128*c* is provided.

This in turn accelerates the stirring of developer, and allows sufficiently charged toner to be effectively supplied to the developing roller 144.

The residual developer preferably drops via the first inclined plane 128*b* in a curtain shape in a first concentration which is equal to or greater than a second concentration in which the residual developer drops via the third inclined plane 128*d* in a curtain shape. This allows the residual developer dropping from the first inclined plane 128*b* in the curtain shape to serve as a partition between the first carrying path P and the second carrying path Q. If the first concentration is less than the second concentration, suspended toner may be blocked by the residual developer dropping from the third inclined plane 128*d* in the curtain shape and thus leak out toward the second carrying path Q, in which the second carrying member 113 is provided. In this case, suspended toner (supplied toner) is less likely to mix with developer, and may be carried over the first inclined plane 128*b* and absorbed by the developing roller 114 to result in an image defect.

As illustrated in FIGS. 8, 9(*a*), and 9(*b*), the third inclined plane 128*d* is inclined so that the rear-end section is lower than the start-end section toward upstream of the direction in which the first carrying member 112 carries developer. With this arrangement, the residual developer carried along and dropping from the third inclined plane 128*d* more effectively causes toner in developer to mix with the developer.

As illustrated in FIG. 9(*b*), the rear-end section of the third inclined plane 128*d* forms a first angle with respect to the rotary shaft of the first carrying member 112 which first angle is equal to an angle at which the first carrying blade 112*a* included in the first carrying member 112 is bent with respect to the first rotary shaft 112*b*. With this arrangement, the residual developer carried along and dropping from the third inclined plane 128*d* allows (i) suspended toner to efficiently mix with developer and (ii) the developer to be efficiently stirred.

In a case where the sliding member 128 is made of a resin containing a conductive carbon black, the sliding member 128 can have a simple arrangement and prevent a change in carrying power for an extended period of time which change is due to triboelectric charging between the sliding member 128 and developer. The sliding member 128 can be made, in its entirety, of a resin containing a conductive carbon black, or have a surface processed with use of a resin containing a conductive carbon black.

In an alternative case where the sliding member 128 is made of a resin containing silica fine particles or fiberglass, it is possible to (i) suppress abrasion of the sliding member 128 against developer by a hard silicon compound exposed on a surface of the sliding member 128 and (ii) continue for an extended period of time to accelerate the mixing of toner with developer. The sliding member 128 can be made, in its entirety, of a resin containing silica fine particles or fiberglass, or have a surface processed with use of a resin containing silica fine particles or fiberglass.

The image forming apparatus 100 includes the developing device 2, which accelerates the stirring of developer and supplies sufficiently charged toner to the developing roller 114, reduces problematic toner scattering and photographic fog, and stably forms high-quality images for an extended period of time.

<Carrier>

The present embodiment preferably uses a carrier having a 50% particle size (D50) based on volume which particle size falls within a range from 15 to 70 μm. The D50 falls more preferably within a range from 25 to 60 μm, and even more preferably within a range 30 to 55 μm.

In a case where the D50 of the carrier is less than 15 μm, the developer, although forming an even and dense brush on the development sleeve 119, forms a short magnetic brush chain. As such, it is necessary to provide a gap (developing area) between the photoreceptor 3 and the development sleeve 119 which gap is extremely small (for example, in a range from 0.1 to 0.3 mm). As a result, a very expensive developing device is required. In the case where the D50 of the carrier is less than 15.0 μm, there is a tendency that (i) the developer has a decreased fluidity and that supplied toner has a poor rise of charging. Further, in the case where the D50 is less than 15.0 μm, particles of the carrier are likely to be attached to the photoreceptor 3 due to an image charge between the photoreceptor 3 and the carrier. This may prevent stable formation of a toner layer on the development sleeve 119, or cause a small scratch on the photoreceptor 3.

In contrast, in a case where the D50 of the carrier exceeds 70 μm, the developer forms by magnetism a long brush, which causes nonuniform brushing (that is, a uniform magnetic brush chain is not formed easily, so that the developer consequently has a rough surface). This problem tends to decrease image quality. Further, in the case where the D50 of the carrier exceeds 70 μm, the carrier has a small specific surface area, so that it is impossible to sufficiently charge toner. The magnetic brush chain also tends to be rigid. As such, there may occur nonuniform brushing in a developer layer on the development sleeve 119, and consequently, an image of good quality may not be formed.

The carrier of the present embodiment preferably has a true specific gravity which falls within a range from 3.0 to 3.8 $g/cm^3$. A developer containing a carrier having a true specific gravity within the above range has only a small load on the toner even when the carrier is stirred and mixed with the toner, and toner-spent on the carrier is prevented. Further, a carrier having a true specific gravity within the above range is preferable in that it allows a good toner layer to be formed on the development sleeve 119 and that even if it is attached to the development sleeve 119 or the photoreceptor 3, the carrier is not likely to damage the photoreceptor 3.

With the true specific gravity of the carrier within the above range, in a case where a mixture of a toner and a carrier is used as a supply (so called trickle development system), a developer can desirably be supplied in a stable manner. As such, the sliding member 128 of the present embodiment can also be arranged for use in a developing device employing the trickle development system. In the trickle development system, a developer in the developing tank has properties which are similar, in terms of both specific gravity and fluidity, to those of a developer to be supplied (including a toner and a carrier which have been mixed in advance). As such, it is possible to stably supply a developer as compared to a case of supplying only toner.

The true specific gravity of the carrier for use in the present embodiment can be adjusted by adjusting production conditions such as a kind of a material, a material composition ratio, and a burning temperature for a core production.

The carrier for use in the present embodiment has a magnetization intensity (σ1000) measured in a magnetic field of 1000/4 π (kA/m) (1000 oersteds) which magnetization intensity falls preferably within a range from 40 to 70 $Am^2/kg$, more preferably within a range from 50 to 70 $Am^2/kg$, and even more preferably within a range from 55 to 65 $Am^2/kg$.

In a case where the carrier has a magnetization intensity (σ1000) within the above range, the carrier is prevented from being attached to the development sleeve 119 or the photoreceptor 3. As such, a developer containing the carrier has an improved durability in use.

In a case where the carrier has a magnetization intensity (σ1000) which exceeds 70 $Am^2/kg$, there is a large stress on toner in a magnetic brush chain formed of the developer, and the toner is thus likely to be degraded. Further, the carrier is likely to be subjected to toner-spent. In a case where the carrier has a magnetization intensity (σ1000) which is less than 40 $Am^2/kg$, the carrier has only a weak magnetic bond to the development sleeve 119. As such, even if the carrier is substantially spherical, it is likely to be attached to the development sleeve 119 or the photoreceptor 3, and a voltage for removing background photographic fog may be narrowed in latitude.

The magnetization intensity of the carrier for use in the present embodiment can be adjusted by appropriately selecting a kind and amount of a magnetic substance to be contained.

The magnetization intensity of the carrier for use in the present embodiment can be measured, for example, with use of oscillating magnetic field type magnetic property automatic recorder BHV-30 of Riken Denshi Co., Ltd. through the following steps: First, a carrier is filled into a cylindrical plastic container at a sufficient density. In the meantime, an external magnetic field of 1000/4 π (kA/m) (1000 oersteds) is applied to the container. In this state, a magnetic moment of the carrier filled in the container is measured. Then, an actual mass of the carrier filled in the container is measured to determine a magnetization intensity ($Am^2/kg$) of the carrier.

The carrier for use in the present embodiment preferably includes a carrier core which is a porous core containing ferrite, because such a carrier core is excellent in productivity. A ferrite-containing carrier core, even if it contains a large amount of resin so as to be low in density, has resin impregnated in pores thereof, and desirably has an improved adhesiveness due to an added resin layer. A "porous carrier core" as described herein refers to a core having pores internally or superficially.

The above core can be prepared by, for example, (i) lowering a burning temperature so as to reduce growth of crystal or (ii) adding a pore forming agent such as a foaming agent so as to form pores in the core. A method for preparing the core is, however, not limited to the above.

<Transparent Toner>

The toner for use in the present embodiment can include a transparent toner. A transparent toner is held on a surface of a recording sheet, and a colored toner is then provided over the transparent toner. This reduces influence of unevenness of the surface of a recording sheet, and improves color reproducibility and gloss with use of a smaller amount of a colored toner. It follows that it is possible to form a colored toner image having a higher resolution. In this case, a transparent toner is first laminated with a recording sheet so that unevenness on the surface of the recording sheet is buried underneath.

The transparent toner of the present embodiment is a toner made of a resin which is high in light-transmitting property and which substantially contains no coloring agent. The transparent toner is preferably made up of particles which has a number average particle size that falls within a range from 1 to 25 μm, which is substantially colorless, and which transmits at least visible light well without substantially scattering it.

The transparent toner can include any additional component according to need. In a case where, for example, the transparent toner additionally includes a wax, a fatty acid, or a metal salt of a fatty acid, a uniform film is easily formed when the transparent toner is fused so as to be fixed. This improves transparency of the transparent toner, and thus forms a color image which has an excellent surface gloss. Further, it is also possible to prevent offset when an image is fixed with use of a heat roller. The transparent toner can include, other than the above, an external additive such as silica, alumina, titania, and organic resin particles so as to ensure that the toner is fluid and capable of being charged.

<Colored Toner>

The present embodiment uses four colored toners (namely, yellow, magenta, cyan, and black) so as to form images of the four colors. The colors are, however, not particularly limited to the above four colors. The colored toners can be of six colors including, other than the above four, colors such as light cyan (LC), which is identical in hue to cyan and lower in concentration than cyan, and light magenta (Lm), which is identical in hue to magenta and lower in concentration than magenta. The colored toners can each have a number average particle size which falls within a range from, for example, 1 to 25 μm.

The present embodiment adjusts a weight of toner contained in a region of a transferred image having an image area rate of 100% which weight falls within a range from 0.20 to 0.40 $mg/cm^2$. In a case of a transferred image of a process black (obtained by overlapping images of the three colors yellow, cyan, and magenta), the present embodiment adjusts the weight of toner contained in a region of a transferred image having an image area rate of 100% so that the weight falls within a range from 0.6 to 1.2 $mg/cm^2$.

In a case where the toner weight is less than 0.20 mg, it is impossible to achieve a sufficient image density. In a reverse case where the toner weight is greater than 0.40 mg, a large amount of toner needs to be supplied to the photoreceptor 3, and an amount of toner consumption is greater. As a result, there may be a decrease in efficiency in transferring toner from the photoreceptor 3 to the intermediate transfer belt 7 having no ends.

The present embodiment uses a toner which can be produced by a production normal method such as a grinding method, suspension polymerization, emulsion polymerization, solution polymerization, and ester elongation polymerization.

<Arrangement of Present Invention>

As described above, a developing device of the present invention is a developing device including: a developer container for storing a developer including a toner and a carrier; a developing roller provided in the developer container; a carrying path including a first side wall and a second side wall, the first side wall being closer to the developing roller than the second side wall is; a carrying member which is provided in the carrying path and which rotates about a rotary shaft so as to carry the developer while stirring the developer; and a supply opening which is formed in an upper wall of the developer container and via which the toner is supplied into the carrying path; the developing roller (i) rotating while holding, on a surface, the developer that has been carried by the carrying member and (ii) supplying the developer to an image bearing member in a developing area, in which the developing roller faces the image bearing member, and the developing device further including: a developer collecting guide member which is provided downstream from the developing area in a rotational direction of the developing roller and which carries a residual developer on the surface of the developing roller in a direction from the developing roller to the carrying member, the developer collecting guide member including: a first inclined plane which guides the residual developer to a first position in the carrying path which first position is between the first side wall and the rotary shaft of the carrying member; and a second inclined plane which has an angle of inclination, the angle being smaller than an angle of inclination of the first inclined plane and which guides the residual developer to the carrying path, the second inclined plane (i) having an end section present downstream in a first direction in which the residual developer is guided on the second inclined plane, the end section reaching a second position between the second side wall and the rotary shaft of the carrying member and (ii) tapering in area to the end section.

The above arrangement allows a residual developer guided via the first inclined plane and the second inclined plane to hold down supplied toner in the carrying path while the toner is mixed with the developer. The above arrangement thus accelerates the mixing of toner with developer. The residual developer guided via the second inclined plane is guided to the carrying path in a bent direction as described above. This further improves efficiency in the mixing of toner with developer.

The developing device of the present invention thus accelerates the mixing of toner with developer and the stirring of developer, and consequently supplies sufficiently charged toner to the developing roller. As such, it is possible to reduce problematic toner scattering and photographic fog.

In addition to the above arrangement, the developing device of the present invention may be arranged such that the second inclined plane tapers in area to the end section at a portion present on an upstream side in a second direction in which the carrying member carries the developer.

According to the above arrangement, the second inclined plane tapers in area to the end section at a portion present on the upstream side in the second direction in which the carrying member carries the developer. As such, it is possible to effectively achieve the above bent direction for the developer. The second inclined plane can alternatively taper in area to an end section which is present downstream in the direction in which the carrying member carries developer. However, in the case where the second inclined plane tapers in area to the end section which is present upstream in the direction in which the carrying member carries developer, the residual developer drops in such a direction as to face the direction in which the carrying member carries developer. The above arrangement thus effectively allows toner which is suspended, such as supplied toner, to mix with developer.

In addition to the above arrangement, the developing device of the present invention may be arranged such that the first inclined plane has an end section present downstream in a third direction in which the residual developer is guided on the first inclined plane, the end section being positioned vertically above the first side wall and extending along a longitudinal direction of the first side wall.

According to the above arrangement, the first inclined plane has an end section present downstream in the third direction in which the residual developer is guided on the first inclined plane, the end section being positioned vertically above the first side wall and extending along a longitudinal direction of the first side wall. As such, the developer guided via the first inclined plane allows toner suspended in a carrying path to effectively mix with developer in the carrying path. Further, it is possible to prevent toner from scattering to the outside of the carrying path.

In a case of, for example, a developing device in which (i) the carrying member provided in the carrying path is a first carrying member provided in a first carrying path and (ii) a second carrying member is provided in a second carrying path so as to be separated from the first carrying member by the first side wall as a partition wall, it is possible to prevent toner from scattering to the second carrying path. In other words, it is possible to both accelerate the mixing of toner with developer in the first carrying path and prevent toner from scattering to the second carrying path or to the outside.

In addition to the above arrangement, the developing device of the present invention may further include: a third inclined plane for guiding, to the carrying path, the residual developer that has been carried via the second inclined plane, wherein: the third inclined plane has (i) a start-end section for receiving the residual developer from the second inclined plane, the start-end section coinciding with a side of the second inclined plane which side is present on an upstream side in a second direction in which the carrying member carries the developer, and (ii) a rear-end section from which the residual developer drops, the rear-end section being positioned vertically above the carrying member and being provided so as to form a predetermined angle with respect to the rotary shaft of the carrying member.

According to the above arrangement, in a case where the residual developer is carried along the third inclined plane and drops therefrom, it is possible to guide the residual developer to the carrying path without diffusing the residual developer. As such, the developing device further improves efficiency in the mixing of toner with developer.

In addition to the above arrangement, the developing device of the present invention may be arranged such that the third inclined plane is inclined so that the rear-end section is lower than the start-end section toward the upstream side of the second direction.

According to the above arrangement, the third inclined plane is inclined so that the rear-end section is lower than the start-end section toward the upstream side of the second direction. With this arrangement, the residual developer carried along and dropping from the third inclined plane more effectively causes toner to mix with developer.

In addition to the above arrangement, the developing device of the present invention may be arranged such that the carrying member includes (i) a shaft member and (ii) a spiral blade wound around the shaft member, the predetermined angle being equal to an angle by which the blade is bent with respect to the shaft member.

According to the above arrangement, the predetermined angle is equal to an angle by which the blade is bent with respect to the shaft member. With this arrangement, the residual developer carried along and dropping from the third inclined plane allows (i) suspended toner to efficiently mix with developer and (ii) the developer to be efficiently stirred.

In addition to the above arrangement, the developing device of the present invention may be arranged such that the first inclined plane is circumscribed with the developing roller.

According to the above arrangement, the first inclined plane is circumscribed with the developing roller. This arrangement suppresses a change in carrying power (speed) when the residual developer on the surface of the developing roller is transferred (collected) to the first inclined plane. The arrangement thus allows the first inclined plane and the second inclined plane to evenly carry the residual developer.

In addition to the above arrangement, the developing device of the present invention may be arranged such that the developing roller includes: a rotatable cylindrical development sleeve; and a magnet roller which is provided inside the development sleeve and which includes (i) a fixing shaft and (ii) a plurality of magnetic poles alternately fixed around the fixing shaft; and the developer collecting guide member includes a collection section for collecting the residual developer from the developing roller, the collection section facing the developing roller at such a position as to (i) correspond to a portion of the development sleeve which portion corresponds to a first region of the magnet roller in which first region none of the plurality of magnetic poles is provided and (ii) be upstream in a rotational direction of the development sleeve from a position which halves an angle formed, with use of a rotary shaft of the developing roller as a center, by two of the plurality of magnetic poles which two sandwich the first region.

According to the above arrangement, the collection section of the developer collecting guide member which collection section collects a residual developer faces the developing roller at the above position. As such, it is possible to suppress (i) a change in carrying power (speed) and (ii) stress on the developer when the residual developer on the surface of the developing roller is transferred (collected) to the developer collecting guide member.

In addition to the above arrangement, the developing device of the present invention the developer collecting guide member includes a collection section for collecting the residual developer from the developing roller, the collection section corresponding to a first uppermost section of the first inclined plane; and the second inclined plane has a second uppermost section present downstream from the first uppermost section in a third direction in which the residual developer is carried via the first inclined plane.

If inclined planes with different inclines face the surface of the developing roller, when a residual developer on the surface of the developing roller is transferred to the developer collecting guide member, there occurs a difference in transfer speed, thereby causing a developer with a nonuniform density to slide against the development sleeve. According to the above arrangement of the present invention, on the other hand, the residual developer on the surface of the developing roller is collected only by the collection section of the developer collecting guide member, that is, by the first uppermost section of the first inclined plane. This prevents the above problem and thus leaves no such nonuniform trace on the developing roller.

In addition to the above arrangement, the developing device of the present invention may be arranged such that the developing device includes a plurality of the second inclined plane provided so as to be spaced from one another in a second direction in which the carrying member carries the developer.

According to the above arrangement, the developing device includes a plurality of the second inclined plane provided so as to be spaced from one another in the second direction in which the carrying member carries the developer. As such, it is possible to accelerate the mixing of toner with developer at positions at which the plurality of the second inclined plane is provided. This in turn accelerates the stirring of developer, and allows sufficiently charged toner to be effectively supplied to the developing roller.

In addition to the above arrangement, the developing device of the present invention the developer collecting guide member is made of a resin containing a conductive carbon black.

According to the above arrangement, the developer collecting guide member is made of a resin containing a conductive carbon black. As such, the developer collecting guide member can have a simple arrangement and prevent a change in carrying power for an extended period of time which change is due to triboelectric charging between the developer collecting guide member and developer. The developer collecting guide member can be made, in its entirety, of a resin containing a conductive carbon black, or have a surface processed with use of a resin containing a conductive carbon black.

In addition to the above arrangement, the developing device of the present invention the developer collecting guide member is made of a resin containing one of a silica fine particle and fiberglass.

According to the above arrangement, the developer collecting guide member is made of a resin containing one of a silica fine particle and fiberglass. As such, it is possible to (i) suppress abrasion of the developer collecting guide member against developer by a hard silicon compound exposed on a surface of the developer collecting guide member and (ii) continue for an extended period of time to achieve the above advantage of the developing device of the present invention. The developer collecting guide member can be made, in its entirety, of a resin containing silica fine particles or fiberglass, or have a surface processed with use of a resin containing silica fine particles or fiberglass.

In order to solve the above problem, an image forming apparatus of the present invention includes: an image bearing member having a surface on which an electrostatic latent image is formed; a charging device for charging the surface of the image bearing member; an exposure device for forming an electrostatic latent image on the surface of the image bearing member; a developing device for forming a toner image by supplying a toner to the electrostatic latent image; a transfer device for transferring, onto a recording material, the toner image on the surface of the image bearing member; and a fixing device for fixing, on the recording material, the toner image that has been transferred onto the recording material, the developing device being any of the developing devices recited above.

According to the above arrangement, the image forming apparatus of the present invention includes a developing device of the present invention which developing device (i) accelerates the mixing of toner with developer and the stirring of developer and consequently (ii) supplies sufficiently charged toner to the developing roller. The image forming apparatus thus reduces problematic toner scattering and photographic fog, and stably forms high-quality images for an extended period of time.

The present invention is not limited to the description of the embodiments above, but may be altered by a skilled person within the scope of the claims. An embodiment based on a proper combination of technical means disclosed in different embodiments is encompassed in the technical scope of the present invention.

Industrial Applicability

The present invention is applicable to, for example, a developing device which uses a two-component developer including a toner and a magnetic carrier and which is included in an image forming apparatus, such as a printer, a copying machine, a facsimile, and a MFP (multi function printer), which employs an electrophotographic printing method.

Reference Signs List

2 developing device
3 photoreceptor (image bearing member)
100 image forming apparatus
111 developing tank (developer container)
111*a* side wall (second side wall)
112 first carrying member (carrying member)
112*a* first carrying blade (blade)
112*b* first rotary shaft (shaft member)
113 second carrying member
113*a* second carrying blade
113*b* second rotary shaft
114 developing roller
115 developing tank cover (upper wall)
115*a* toner supply opening (supply opening)

116 doctor blade
117 partition wall (first side wall)
118 permeability sensor
119 development sleeve
120 magnet roller
121 toner container
122 toner discharge member
123 toner discharge opening
124 toner discharge member blocking wall
125 toner-stirring member
126 magnet fixing shaft
127 developer releasing region
128 sliding member (developer collecting guide member)
128*a* collection section
128*b* first inclined plane
128*c* second inclined plane
128*d* third inclined plane
129 partition wall side upper surface region
134 toner discharge member driving motor
P first carrying path (carrying path)
Q second carrying path

The invention claimed is:

1. A developing device, comprising:

a developer container for storing a developer including a toner and a carrier;

a developing roller provided in the developer container;

a carrying path including a first side wall and a second side wall, the first side wall being closer to the developing roller than the second side wall is;

a carrying member which is provided in the carrying path and which rotates about a rotary shaft so as to carry the developer while stirring the developer; and a supply opening which is formed in an upper wall of the developer container and via which the toner is supplied into the carrying path;

the developing roller (i) rotating while holding, on a surface, the developer that has been carried by the carrying member and (ii) supplying the developer to an image bearing member in a developing area, in which the developing roller faces the image bearing member, and the developing device further comprising:

a developer collecting guide member which is provided downstream from the developing area in a rotational direction of the developing roller and which carries a residual developer on the surface of the developing roller in a direction from the developing roller to the carrying member, the developer collecting guide member including:

a first inclined plane which guides the residual developer to a first position in the carrying path which first position is between the first side wall and the rotary shaft of the carrying member; and a second inclined plane which has an angle of inclination, the angle being smaller than an angle of inclination of the first inclined plane and which guides the residual developer to the carrying path, the second inclined plane (i) having an end section present downstream in a first direction in which the residual developer is guided on the second inclined plane, the end section reaching a second position between the second side wall and the rotary shaft of the carrying member and (ii) tapering in area to the end section, and further comprising:

a third inclined plane for guiding, to the carrying path, the residual developer that has been carried via the second inclined plane, wherein:

the third inclined plane has (i) a start-end section for receiving the residual developer from the second inclined plane, the start-end section coinciding with a side of the second inclined plane which side is present on an upstream side in a second direction in which the carrying member carries the developer, and (ii) a rear-end section from which the residual developer drops, the rear-end section being positioned vertically above the carrying member and being provided so as to form a predetermined angle with respect to the rotary shaft of the carrying member.

2. The developing device according to claim 1, wherein:

the second inclined plane tapers in area to the end section at a portion present on an upstream side in a second direction in which the carrying member carries the developer.

3. The developing device according to claim 1, wherein:

the first inclined plane has an end section present downstream in a third direction in which the residual developer is guided on the first inclined plane, the end section being positioned vertically above the first side wall and extending along a longitudinal direction of the first side wall.

4. The developing device according to claim 1, wherein:

the third inclined plane is inclined so that the rear-end section is lower than the start-end section toward the upstream side of the second direction.

5. The developing device according to claim 1, wherein:

the carrying member includes (i) a shaft member and (ii) a spiral blade wound around the shaft member, the predetermined angle being equal to an angle by which the blade is bent with respect to the shaft member.

6. The developing device according to claim 1, wherein:

the first inclined plane is circumscribed with the developing roller.

7. The developing device according to claim 1, wherein:

the developing roller includes:

a rotatable cylindrical development sleeve; and a magnet roller which is provided inside the development sleeve and which includes (i) a fixing shaft and (ii) a plurality of magnetic poles alternately fixed around the fixing shaft; and the developer collecting guide member includes a collection section for collecting the residual developer from the developing roller, the collection section facing the developing roller at such a position as to (i) correspond to a portion of the development sleeve which portion corresponds to a first region of the magnet roller in which first region none of the plurality of magnetic poles is provided and (ii) be upstream in a rotational direction of the development sleeve from a position which halves an angle formed, with use of a rotary shaft of the developing roller as a center, by two of the plurality of magnetic poles which two sandwich the first region.

8. The developing device according to claim 1, wherein:

the developer collecting guide member includes a collection section for collecting the residual developer from the developing roller, the collection section corresponding to a first uppermost section of the first inclined plane; and the second inclined plane has a second uppermost section present downstream from the first uppermost section in a third direction in which the residual developer is carried via the first inclined plane.

9. The developing device according to claim 1, wherein:

the developing device comprises a plurality of the second inclined plane provided so as to be spaced from one another in a second direction in which the carrying member carries the developer.

10. The developing device according to claim 1, wherein:

the developer collecting guide member is made of a resin containing a conductive carbon black.

11. The developing device according to claim 1, wherein:

the developer collecting guide member is made of a resin containing one of a silica fine particle and fiberglass.

12. An image forming apparatus, comprising:

an image bearing member having a surface on which an electrostatic latent image is formed;

a charging device for charging the surface of the image bearing member;

an exposure device for forming an electrostatic latent image on the surface of the image bearing member;

a developing device for forming a toner image by supplying a toner to the electrostatic latent image;

a transfer device for transferring, onto a recording material, the toner image on the surface of the image bearing member; and a fixing device for fixing, on the recording material, the toner image that has been transferred onto the recording material, the developing device being the developing device recited in claim 1.

* * * * *